US011747770B2

(12) United States Patent
Tezuka

(10) Patent No.: US 11,747,770 B2
(45) Date of Patent: Sep. 5, 2023

(54) WATCH AND METHOD FOR CONTROLLING WATCH

(71) Applicant: Seiko Epson Corporation, Tokyo (JP)

(72) Inventor: Chisato Tezuka, Okaya (JP)

(73) Assignee: SEIKO EPSON CORPORATION

( * ) Notice: Subject to any disclaimer, the term of this patent is extended or adjusted under 35 U.S.C. 154(b) by 369 days.

(21) Appl. No.: 16/940,483

(22) Filed: Jul. 28, 2020

(65) Prior Publication Data

US 2021/0034020 A1 Feb. 4, 2021

(30) Foreign Application Priority Data

Jul. 29, 2019 (JP) ..... 2019-138616

(51) Int. Cl.

| | |
|---|---|
| ***G04G 21/04*** | (2013.01) |
| ***G04R 20/04*** | (2013.01) |
| ***G04R 60/10*** | (2013.01) |
| ***G04G 17/04*** | (2006.01) |

(52) U.S. Cl.

CPC ..... *G04R 20/04* (2013.01); *G04G 17/04* (2013.01); *G04G 21/04* (2013.01); *G04R 60/10* (2013.01)

(58) Field of Classification Search

CPC ..... G04G 21/04; G04G 17/04; G04R 60/10; G04R 20/04; G04C 3/14

See application file for complete search history.

(56) References Cited

U.S. PATENT DOCUMENTS

| | | | | |
|---|---|---|---|---|
| 2004/0233789 | A1* | 11/2004 | Oguchi | G04G 21/04 368/47 |
| 2011/0051561 | A1 | 3/2011 | Fujisawa | |
| 2013/0051188 | A1* | 2/2013 | Akiyama | G04R 60/14 368/47 |
| 2013/0235703 | A1 | 9/2013 | Fujisawa | |
| 2014/0022871 | A1 | 1/2014 | Fujisawa | |
| 2014/0233358 | A1 | 8/2014 | Fujisawa | |
| 2015/0092521 | A1 | 4/2015 | Fujisawa | |
| 2015/0192904 | A1* | 7/2015 | Kato | G04R 20/06 368/47 |

(Continued)

FOREIGN PATENT DOCUMENTS

| | | | |
|---|---|---|---|
| JP | 2010-096523 | A | 4/2010 |
| JP | 2011-053159 | A | 3/2011 |

(Continued)

*Primary Examiner* — Sean Kayes

(74) *Attorney, Agent, or Firm* — Harness, Dickey & Pierce, P.L.C.

(57) ABSTRACT

A watch includes an hour hand having a first conductive portion and rotating about an hour hand shaft, a seconds hand having a second conductive portion and rotating at a rotational speed faster than that of the hour hand about a seconds hand shaft, which is coaxial with the hour hand shaft, and a planar inverted-F antenna disposed, in plan view viewed from a direction parallel to the hour hand shaft, at a position overlapping a rotation range of the first conductive portion and a rotation range of the second conductive portion, and receiving a radio wave, and when the planar inverted-F antenna receives a radio wave, a controller, after rotating the seconds hand and then stopping the seconds hand at a reception indication position, rotates the hour hand such that the first conductive portion and the second conductive portion overlap each other in the plan view.

9 Claims, 18 Drawing Sheets

(56) References Cited

U.S. PATENT DOCUMENTS

| | | | | |
|---|---|---|---|---|
| 2015/0323907 | A1 | 11/2015 | Fujisawa | |
| 2016/0161924 | A1 | 6/2016 | Fujisawa | |
| 2016/0259304 | A1 | 9/2016 | Fujisawa | |
| 2016/0299471 | A1* | 10/2016 | Nagahama | G04B 19/04 |
| 2017/0038744 | A1 | 2/2017 | Fujisawa | |
| 2017/0082983 | A1* | 3/2017 | Katzer | G04B 47/066 |
| 2017/0146960 | A1 | 5/2017 | Fujisawa | |
| 2017/0261944 | A1 | 9/2017 | Fujisawa | |
| 2017/0293268 | A1 | 10/2017 | Fujisawa | |
| 2018/0164750 | A1 | 6/2018 | Akiyama | |
| 2018/0239308 | A1 | 8/2018 | Yamamoto et al. | |
| 2018/0246477 | A1 | 8/2018 | Fujisawa | |
| 2018/0307186 | A1 | 10/2018 | Fujisawa | |
| 2019/0286069 | A1 | 9/2019 | Yamamoto et al. | |
| 2020/0319605 | A1* | 10/2020 | Watanabe | H01Q 9/42 |

FOREIGN PATENT DOCUMENTS

| | | | |
|---|---|---|---|
| JP | 2011-208952 | A | 10/2011 |
| JP | 2016-164531 | A | 9/2016 |
| JP | 2017-161338 | A | 9/2017 |
| JP | 2018-054634 | A | 4/2018 |
| JP | 2018-096830 | A | 6/2018 |
| JP | 2018-136296 | A | 8/2018 |
| JP | 2019-163963 | A | 9/2019 |

* cited by examiner

WATCH AND METHOD FOR CONTROLLING WATCH

The present application is based on, and claims priority from JP Application Serial Number 2019-138616, filed Jul. 29, 2019, the disclosure of which is hereby incorporated by reference herein in its entirety.

BACKGROUND

1. Technical Field

The present disclosure relates to a watch and a method for controlling the watch.

2. Related Art

JP-A-2018-136296 discloses a watch in which a planar inverted-F antenna is disposed in a case of the watch. The planar inverted-F antenna includes a first conductor element, a second conductor element, and a short-circuit portion that are each planar on a rear surface side of a dial. The short-circuit portion short-circuits the first conductor element with the second conductor element.

JP-A-2018-96830 discloses an electronic watch, upon starting a reception process, makes a seconds hand point a predetermined position, and display start information indicating that the reception process is started.

In the watch of JP-A-2018-136296, a pointer overlaps with the first conductor element in plan view, and thus, when the pointer includes a conductive portion constituted by a conductive material such as metal, there was a possibility that parasitic capacitance occurs between the conductive portion of the pointer and the first conductor element, and reception sensitivity decreases.

SUMMARY

Thus, it is conceivable that, by using a plurality of pointers to point a predetermined position to display start information of reception as in the watch of JP-A-2018-96830, respective conductive portions of the plurality of pointers are overlapped with each other, to reduce a decrease in reception sensitivity. However, there was a problem in that the display of the start information of reception is delayed depending on a movement method of the plurality of pointers. In other words, a watch was demanded that, when respective conductive portions of a plurality of pointers are overlapped with each other during reception, can quickly inform an operator that an antenna receives a radio wave.

A watch includes a first pointer having a first conductive portion and configured to rotate about a first shaft as an axis, a second pointer having a second conductive portion and configured to rotate at a rotational speed faster than that of the first pointer about a second shaft, which is coaxial with the first shaft, as an axis, a drive mechanism configured to rotate the first pointer and the second pointer, a controller configured to control rotation of the first pointer and the second pointer, and an antenna disposed, in plan view viewed from a direction parallel to the first shaft, at a position overlapping a rotation range of the first conductive portion and a rotation range of the second conductive portion, and configured to receive a radio wave, wherein when the antenna receives the radio wave, the controller, after rotating the second pointer and then stopping the second pointer at a reception indication position, rotates the first pointer such that the first conductive portion and the second conductive portion overlap each other in the plan view.

A watch includes a first pointer having a first conductive portion and configured to rotate about a first shaft as an axis, a second pointer having a second conductive portion and configured to rotate about a second shaft, which is coaxial with the first shaft, as an axis, a drive mechanism configured to rotate the first pointer and the second pointer, a controller configured to control rotation of the first pointer and the second pointer, and an antenna disposed, in plan view viewed from a direction parallel to the first shaft, at a position overlapping a rotation range of the first conductive portion and a rotation range of the second conductive portion, and configured to receive a radio wave, wherein when the antenna receives the radio wave, the controller rotates the first pointer and the second pointer simultaneously toward a reception indication position such that the first conductive portion and the second conductive portion overlap each other in the plan view.

In the watch described above, the reception indication position may include a first position and a second position, and the controller when receiving the radio wave and detecting a position, may cause the first conductive portion and the second conductive portion to overlap each other at the first position, and, when receiving the radio wave and detecting time, may cause the first conductive portion and the second conductive portion to overlap each other at the second position.

In the watch described above, the radio wave may be transmitted from a position information satellite, the watch further including a receiver configured to process the radio wave received by the antenna and capture the position information satellite, and the controller may rotate the first pointer and the second pointer in a state, in which the first conductive portion and the second conductive portion overlap each other in the plan view, and indicate the number of the position information satellites captured by the receiver.

In the watch described above, the controller may rotate the first pointer and the second pointer in a state, in which the first conductive portion and the second conductive portion overlap each other in the plan view, and indicate strength of the radio wave received by the antenna.

The watch described above may include an input device configured to accept an instruction for manual reception, the controller may include a detector for detecting that a predetermined automatic reception condition is met, the controller may cause the first conductive portion and the second conductive portion to overlap each other in the plan view when the input device accepts an instruction for the manual reception, and the antenna receives the radio wave, and when the detector detects that the automatic reception condition is met, the controller does not perform an operation of causing the first conductive portion and the second conductive portion to overlap each other in the plan view, and the antenna may receive the radio wave and the controller may detect time.

In the watch described above, the rotation of the second pointer and the reception of the radio wave by the antenna may be performed in parallel, and the controller may use the radio wave, which is received, to detect time.

In the watch described above, after the first conductive portion and the second conductive portion are caused to overlap each other in the plan view, the radio wave may be received by the antenna.

The watch described above may include an outer packaging case including a case body, a case back, and a cover member, and a dial disposed between the cover member and the case back in the outer packaging case, wherein the antenna may include a first conductor element that is planar and disposed between the dial and the case back in a side view viewed from a direction perpendicular to the first shaft, a second conductor element that is disposed between the dial and the case back so as to be separated from the first conductor element and overlaps the first conductor element in the plan view, and a short-circuit portion that short-circuits the first conductor element and the second conductor element, and the first shaft to which the first pointer is attached and the second shaft to which the second pointer is attached may be constituted of a conductive material.

A method for controlling a watch is a method for controlling a watch that includes a first pointer having a first conductive portion and rotating about a first shaft as an axis, a second pointer having a second conductive portion and rotating at a rotational speed faster than that of the first pointer about a second shaft, which is coaxial with the first shaft, as an axis, a drive mechanism configured to rotate the first pointer and the second pointer, a controller configured to control rotation of the first pointer and the second pointer, and an antenna disposed, in plan view viewed from a direction parallel to the first shaft, at a position overlapping a rotation range of the first conductive portion and a rotation range of the second conductive portion, and receiving a radio wave, the method including when the antenna receives the radio wave: causing the controller to induce rotation of the second pointer to stop the second pointer at a reception indication position; and after the second pointer stops at the reception indication position, rotation of the first pointer such that the first conductive portion and the second conductive portion overlap each other in the plan view.

DESCRIPTION OF EXEMPLARY EMBODIMENTS

First Exemplary Embodiment

Figure 1:
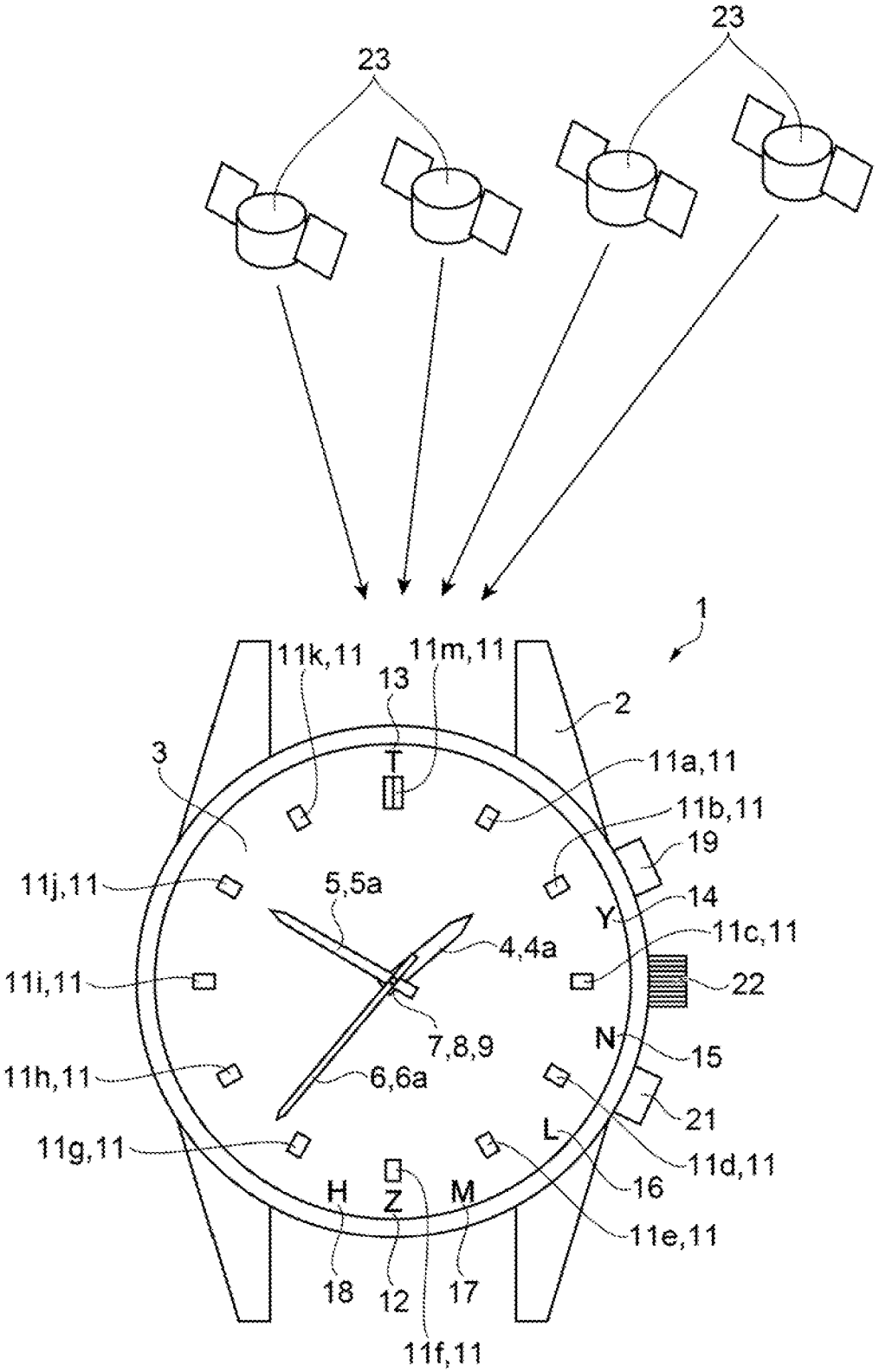
FIG. 1 is a schematic plan diagram illustrating a configuration of a watch according to a first exemplary embodiment.

An antenna-included electronic watch will be described with reference to the drawings. FIG. 1 is a schematic plan diagram illustrating a configuration of a watch. As illustrated in FIG. 1, a watch 1 includes an outer packaging case 2. A dial 3, an hour hand 4 as a first pointer, a minute hand 5, and a seconds hand 6 as a second pointer are disposed inside the outer packaging case 2. The hour hand 4, the minute hand 5, and the seconds hand 6 rotate both in a clockwise direction and in a counterclockwise direction about a center of the dial 3. The rotation in the clockwise direction is also referred to as right-handed or forward rotation. The rotation in the counterclockwise direction is also referred to as left-handed or reverse rotation.

The dial 3 is formed in a disk-shaped, of a non-conductive member such as polycarbonate. An entirety of each of the hour hand 4, the minute hand 5, and the seconds hand 6 is constituted by a metallic conductive material. A first conductive portion 4*a* included in the hour hand 4 is constituted by the entirety of the hour hand 4. A third conductive portion 5*a* included in the minute hand 5 is constituted by the entirety of the minute hand 5. A second conductive portion 6*a* included in the seconds hand 6 is constituted by the entirety of the seconds hand 6.

An hour hand shaft 7 as a first shaft, a minute hand shaft 8, and a seconds hand shaft 9 as a second shaft are disposed at the center of the dial 3. The hour hand shaft 7, the minute hand shaft 8, and seconds hand shaft 9 have an identical axis, and are coaxially disposed. The hour hand shaft 7 is bonded to the hour hand 4. The hour hand shaft 7 may also be referred to as an hour wheel. The hour hand 4 rotates with the hour hand shaft 7 as an axis. The minute hand shaft 8 is bonded to the minute hand 5. The minute hand 5 rotates with the minute hand shaft 8 as an axis. The minute hand shaft 8 is also referred to as a cannon pinion. The seconds hand shaft 9 is bonded to the seconds hand 6.

The seconds hand 6 rotates with the seconds hand shaft 9 as an axis. The hour hand shaft 7 to which the hour hand 4 is attached, and the seconds hand shaft 9 to which the seconds hand 6 is attached are constituted by a conductive material. In particular, metal such as a copper alloy or a ferrous alloy is used for the hour hand shaft 7, the minute hand shaft 8, and the seconds hand shaft 9. Metal is used for the material of the hour hand shaft 7, the minute hand shaft 8, and the seconds hand shaft 9, and thus the hour hand shaft 7, the minute hand shaft 8, and seconds hand shaft 9 support the hour hand 4, the minute hand 5, and the seconds hand 6 with high durability, respectively.

Twelve number of indicators 11 are disposed at equal intervals on the dial 3 along a concentric circle with the hour hand shaft 7 as an axis. A twelfth indicator 11*m* is disposed on an upper side of the hour hand shaft 7 in the drawing. A first indicator 11*a*, a second indicator lib, the third indicator 11*c*, a fourth indicator 11*d*, a fifth indicator 11*e*, a sixth indicator 11*f*, a seventh indicator 11*g*, an eighth indicator 11*h*, a ninth indicator 11*i*, a tenth indicator 11*j*, and an eleventh indicators 11*k* are disposed clockwise in order from the twelfth indicator 11*m*. The first indicator 11*a* to the twelfth indicator 11*m* corresponding to the hour hand 4, indicate 1 o'clock to 12 o'clock of time, respectively. The first indicator 11*a* to the twelfth indicator 11*m* corresponding to the minute hand 5, indicate 5 minutes to 60 minutes of time, respectively. The first indicator 11*a* to the twelfth indicator 11*m* corresponding to the seconds hand 6, indicate 5 seconds to 60 seconds of time, respectively.

A first position 12 is set as a reception indication position, on a side of the sixth indicator 11*f* of the hour hand shaft 7. At the first position 12, a letter Z is displayed. A second position 13 is set as a reception indication position, on a side of the twelfth indicator 11*m* of the hour hand shaft 7. The reception indication position includes the first position 12 and the second position 13. At the second position 13, a letter T is displayed. A third position 14 is set at an intermediate place between the second indicator lib and the third indicator 11*c*. At the third position 14, a letter Y is displayed. A fourth position 15 is set at an intermediate place between the third indicator 11*c* and the fourth indicator 11*d*. At the fourth position 15, a letter N is displayed. A fifth position 16 is set at an intermediate place between the fourth indicator 11*d* and the fifth indicator 11*e*. At the fifth position 16, a letter L is displayed. A sixth position 17 is set at an intermediate place between the fifth indicator 11*e* and the sixth indicator 11*f*. At the sixth position 17, a letter M is displayed. A seventh position 18 is set at an intermediate place between the sixth indicator 11*f* and the seventh indicator 11*g*. At the seventh position 18, a letter H is displayed.

A first button 19 as an input device is disposed on the outer packaging case 2 on a side of the second indicator lib of the hour hand shaft 7. A second button 21 as an input device is disposed on the outer packaging case 2 on a side of the fourth indicator 11*d* of the hour hand shaft 7. The first button 19 and the second button 21 each accept an instruction signal that an operator instructs the watch 1. A crown 22 is disposed on the outer packaging case 2 on a side of the third indicator 11*c* of the hour hand shaft 7. The crown 22 is also referred to as a winding knob. The operator can rotate crown 22 to rotate hour hand 4 and the minute hand 5.

In the sky of the earth, satellites 23 as position information satellites, such as a plurality of GPS satellites or quasi-zenith satellites, each orbit in a predetermined trajectory. The satellite 23 transmits a radio wave including a satellite signal toward the earth. The watch 1 receives a radio wave. The watch 1 is configured to be able to obtain satellite time information indicated by the satellite signal, and to correct internal time information.

Figure 2:
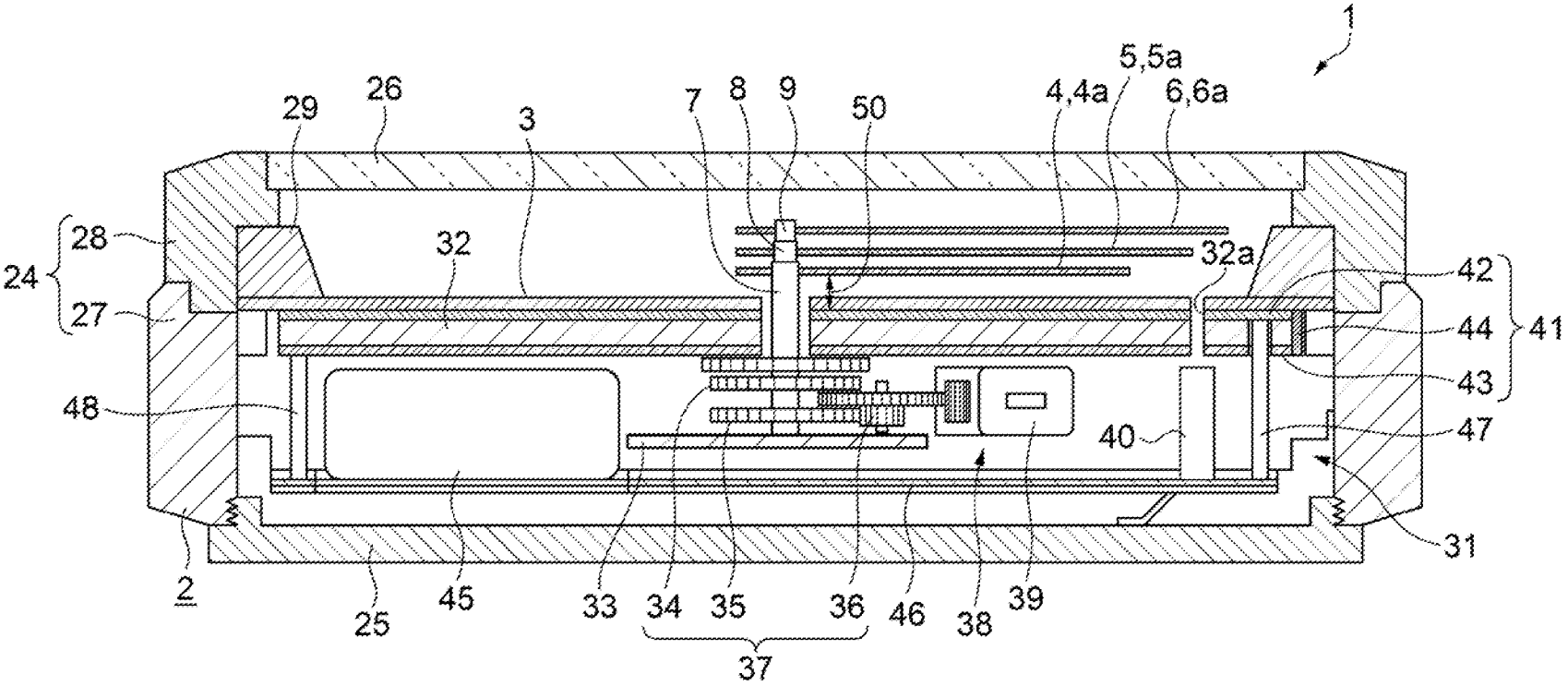
FIG. 2 is a schematic cross-sectional view illustrating the configuration of the watch.

FIG. 2 is a schematic side sectional view illustrating a configuration of the watch. As illustrated in FIG. 2, the outer packaging case 2 includes a case body 27, a case back 25, and a cover member 26. The cover member 26 is also referred to as a windshield. A cylindrical case body 24 is sandwiched between the case back 25 and the cover member 26. An interior of the outer packaging case 2 is sealed. A side on the cover member 26 of the watch 1 is a front surface side or an upper side, and a side on the case back 25 is a rear surface side or a lower side. In the present exemplary embodiment, "in plan view" indicates viewing from an axial direction perpendicular to a surface on a front surface side of the cover member 26, that is, from an axial direction of the hour hand shaft 7.

The case body 24 includes the case body 27 and a bezel 28 that are cylindrical. The bezel 28 is disposed on a front surface side of the case body 27. The case body 27 and the case back 25 are formed of a metal material such as stainless steel, a titanium alloy, aluminum, brass, or the like, or a synthetic resin material. A material of the cover member 26 is light-transmissive glass, a synthetic resin material, or the like. A material of the bezel 28 is a ceramic or metal material such as zirconia, titanium carbide, titanium nitride, or alumina.

A ring-shaped dial ring 29 formed of plastic is disposed on an inner circumferential side of the bezel 28. The dial ring 29 supports the dial 3 that is circular and planar on an inside of the bezel 28. The dial 3 is disposed between the cover member 26 and the case back 25 within the outer packaging case 2. The dial 3 is constituted by a plastic material such as polycarbonate that is non-conductive, and has a transmissive characteristic that transmits light at least partially.

A movement 31 is disposed on a rear surface side of the dial 3. The movement 31 rotates the hour hand shaft 7, the minute hand shaft 8, and the seconds hand shaft 9. A hole is disposed at a center of the dial 3 in plan view. The hour hand shaft 7, the minute hand shaft 8, and the seconds hand shaft 9 are coaxially disposed through this hole.

The movement 31 includes a main plate 32 and a train wheel bridge 33. The main plate 32 is disposed on the rear surface side of the dial 3. The main plate 32 is formed of a non-conductive member such as plastic. The train wheel bridge 33 is disposed on the rear surface side with an interval from the main plate 32. A train wheel 37 constituted by a first train wheel, a second train wheel, a third train wheel 36, and the like is disposed between the main plate 32 and the train wheel bridge 33.

A plurality of toothed gears, such as a center wheel and pinion 34, a fourth wheel and pinion 35, and the like are disposed in the train wheel 37. A bearing supporting a shaft of a toothed gear is disposed on each of the main plate 32 and the train wheel bridge 33.

The movement 31 includes a driver 38 that drives the train wheel 37. The driver 38 includes a first motor, a second motor, and a third motor 39. The first motor, the second motor, and the third motor 39 are step motors. The first motor drives the first train wheel, and the first train wheel rotates the hour hand 4. The second motor drives the second train wheel, and the second train wheel rotates the minute hand 5. The second train wheel includes the center wheel and pinion 34, and a shaft of the center wheel and pinion 34 is the minute hand shaft 8. The third motor 39 drives the third train wheel 36, and the third train wheel 36 rotates the seconds hand 6. The third train wheel 36 includes the fourth wheel and pinion 35, and a shaft of the fourth wheel and pinion 35 is the seconds hand shaft 9.

The main plate 32 is combined with a planar inverted-F antenna 41 as an antenna. The planar inverted-F antenna 41 includes a first conductor element 42, a second conductor element 43, and a short-circuit portion 44.

The main plate 32 is sandwiched between the first conductor element 42 and the second conductor element 43. The first conductor element 42 is positioned on a front surface side of the main plate 32. The second conductor element 43 is positioned on a rear surface side of the main plate 32. In a side view viewed from a direction perpendicular to the hour hand shaft 7, the first conductor element 42 that is planar is disposed between the dial 3 and the case back 25. The second conductor element 43 is disposed between the dial 3 and the case back 25, and is separated from the first conductor element 42. The second conductor element 43 overlaps with the first conductor element 42 in plan view. The short-circuit portion 44 electrically short-circuits the first conductor element 42 with the second conductor element 43. The planar inverted-F antenna 41 receives a radio wave transmitted by the satellite 23.

A battery 45 is disposed on the rear surface side of the main plate 32. A printed wired board 46 is disposed on a rear surface side of the train wheel bridge 33. The battery 45 supplies power to the printed wired board 46. The printed wired board 46 controls operation of the driver 38. A feed element 47 is disposed between the first conductor element 42 and the printed wired board 46, and the feed element 47 electrically couples the first conductor element 42 with the printed wired board 46. A coupling element 48 is disposed between the second conductor element 43 and the printed wired board 46, and the coupling element 48 electrically couples the second conductor element 43 with the printed wired board 46.

A light sensor 40 is disposed on the printed wired board 46. Furthermore, a hole 32*a* is formed in the main plate 32 at a position facing the light sensor 40. The light sensor 40 is irradiated with sunlight, when night transits to morning and the sun rises in the sky. When light detected by the light sensor 40 intensifies, a probability that it is morning is high. When the watch 1 includes a solar cell, the solar cell may be used as the light sensor 40.

Figure 3:
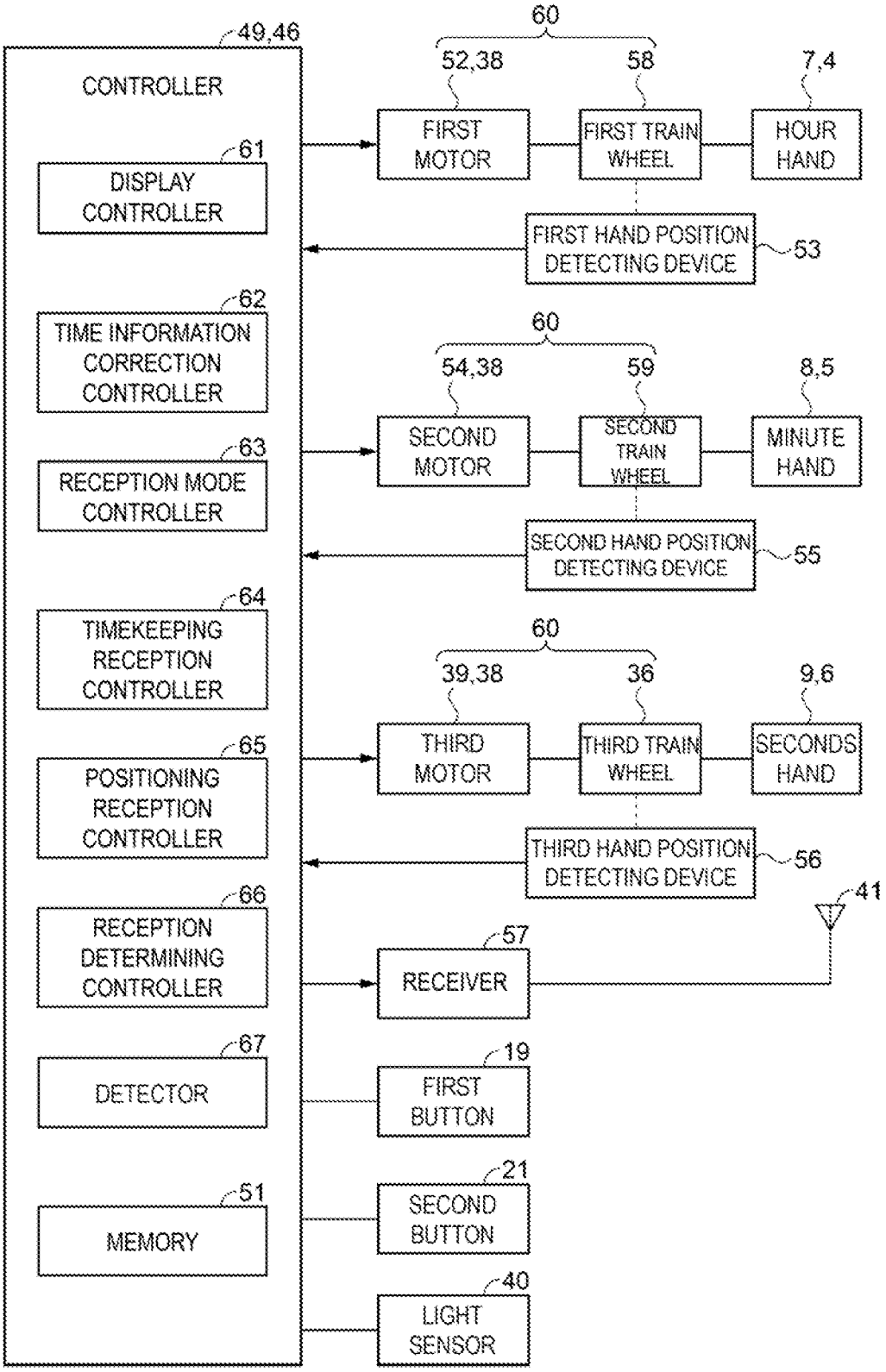
FIG. 3 is an electrical circuit diagram of the watch.

FIG. 3 is an electrical circuit diagram of the watch. As illustrated in FIG. 3, the watch 1 includes a controller 49.

The controller 49 is installed on the printed wired board 46. The controller 49 includes a central processing unit (CPU) that performs various arithmetic processes as a processor, and a memory 51 that stores a variety of information. A first motor 52, a first hand position detecting device 53, a second motor 54, a second hand position detecting device 55, the third motor 39, and a third hand position detecting device 56 are coupled to the controller 49. Furthermore, a receiver 57, the first button 19, the second button 21, and the light sensor 40 are coupled to the controller 49.

The first motor 52 is inputted with a drive signal from the controller 49 and rotates. A first pinion is installed on a shaft of the first motor 52, and the first pinion intermeshes with a first train wheel 58. The first motor 52 transmits torque to the first train wheel 58. The first train wheel 58 transmits torque to the hour hand shaft 7, and the hour hand 4 rotates. A hole for position detection is disposed in at least one of toothed gears of the first train wheel 58. The first hand position detecting device 53 detects the hole for position detection, and outputs a signal indicating a position of a toothed gear of the first train wheel 58 to the controller 49.

Similarly, the second motor 54 is inputted with a drive signal from the controller 49 and rotates. A second pinion is installed on a shaft of the second motor 54, and the second pinion intermeshes with a second train wheel 59. The second motor 54 transmits torque to the second train wheel 59. The second train wheel 59 transmits torque to the minute hand shaft 8, and the minute hand 5 rotates. A hole for position detection is disposed in at least one of toothed gears of the second train wheel 59. The second hand position detecting device 55 detects the hole for position detection, and outputs a signal indicating a position of a toothed gear of the second train wheel 59 to the controller 49.

Similarly, the third motor 39 is inputted with a drive signal from the controller 49 and rotates. A third pinion is installed on a shaft of the third motor 39, and the third pinion intermeshes with the third train wheel 36. The third motor 39 transmits torque to the third train wheel 36. The third train wheel 36 transmits torque to the seconds hand shaft 9, and the seconds hand 6 rotates. A hole for position detection is disposed in at least one of toothed gears of the third train wheel 36. The third hand position detecting device 56 detects the hole for position detection, and outputs a signal indicating a position of a toothed gear of the third train wheel 36 to the controller 49.

The first motor 52 and the first train wheel 58 form a drive mechanism 60 for rotating the hour hand 4. The second motor 54 and the second train wheel 59 form the drive mechanism 60 for rotating the minute hand 5. The third motor 39 and the third train wheel 36 form the drive mechanism 60 for rotating the seconds hand 6. The drive mechanism 60 includes the first motor 52, the first train wheel 58, the second motor 54, the second train wheel 59, the third motor 39, and the third train wheel 36. The drive mechanisms 60 rotates the hour hand 4, the minute hand 5 and the seconds hand 6, respectively.

The first hand position detecting device 53, the second hand position detecting device 55, and the third hand position detecting device 56 each include a light emitting element and a photoreceptor element. The light emitting elements irradiate the first train wheel 58, the second train wheel 59, and the third train wheel 36, respectively. The photoreceptor elements detect the respective holes for position detection provided in the first hand position detecting device 53, the second hand position detecting device 55, and the third hand position detecting device 56, respectively.

The receiver 57 is electrically coupled with the planar inverted-F antenna 41. The receiver 57 performs reception processing by the planar inverted-F antenna 41. The satellite 23 transmits a radio wave that includes a satellite signal. The receiver 57 processes a radio wave received by the planar inverted-F antenna 41 to capture the satellite 23. A satellite signal includes time information, and the time information included in the satellite signal is referred to as GPS time information. In addition, the satellite signal includes satellite orbital information.

The CPU drives the watch 1 according to a program stored in the memory 51. The controller 49, that is operated by the CPU according to the program includes, as specific function achieving units, a display controller 61, a time information correction controller 62, a reception mode controller 63, a time keeping reception controller 64, a positioning reception controller 65, and a reception determining controller 66. The display controller 61 drives the first motor 52, the second motor 54, and the third motor 39, to control positions of the hour hand 4, the minute hand 5, and the seconds hand 6, respectively. That is, the controller 49 controls rotation of the hour hand 4 and the seconds hand 6.

A state in which operation for time correction is not performed is defined as a normal state. In the normal state, the display controller 61 rotates the seconds hand 6 by six degrees per second. The display controller 61 rotates the minute hand 5 by six degrees per minute. The display controller 61 rotates the hour hand 4 by 0.5 degrees per minute. Note that, an angle that corresponds to one rotation of each of the hour hand 4, the minute hand 5, and the seconds hand 6 is defined as 360 degrees.

The display controller 61 actuates the first hand position detecting device 53, the second hand position detecting device 55, and the third hand position detection device 56, at predetermined timing, such as 0:0:0. The display controller 61 performs a hand position detecting process that checks whether the hour hand 4, the minute hand 5, and the seconds hand 6 are at a predetermined position, for example, a position displaying 0:0:0.

When the planar inverted-F antenna 41 receives a radio wave, the display controller 61 performs a receiving movement process, in which the first motor 52, the second motor 54, and the third motor 39 are actuated, the hour hand 4, the minute hand 5, and the seconds hand 6 are moved to a standby position during reception and the hands are stopped. When the planar inverted-F antenna 41 receives a radio wave, the display controller 61, after rotating the seconds hand 6 and stopping the seconds hand 6 at the first position 12 or the second position 13, rotates the hour hand 4 and the minute hand 5, and overlaps the first conductive portion 4*a*, the third conductive portion 5*a*, and the second conductive portion 6*a* with each other in plan view.

A maximum value of a rotational speed of each of the first motor 52, the second motor 54, and the third motor 39 is identical. The first train wheel 58 and the second train wheel 59 each have a higher speed reduction ratio than that of the third train wheel 36. Thus, the seconds hand 6 rotates at a faster rotational speed, compared to the minute hand 5 and the hour hand 4.

The time information correction controller 62 corrects time data, using GPS time information. The time information correction controller 62 computes time difference data from satellite orbital information. Then, the time data is corrected in accordance with the time difference data.

The reception mode controller 63 detects a predetermined operation by each of the first button 19 and the second button 21. Then, the reception mode controller 63 controls performance of various types of reception processing. Then, the first button 19 accepts a reception instruction for positioning reception of a satellite signal operated by the operator. In addition, the second button 21 accepts a reception instruction for time keeping reception of a satellite signal operated by the operator. Various instruction contents are assigned to operations for the first button 19 and the second button 21.

The time keeping reception controller 64 activates the receiver 57 to perform the time keeping reception. Then, the receiver 57 receives at least one satellite signal, and the time keeping reception controller 64 performs time keeping reception processing for obtaining GPS time information from the received satellite signal. The time information correction controller 62 uses the GPS time information to correct the time data.

The positioning reception controller 65 activates the receiver 57 to perform the positioning reception. The receiver 57 receives satellite signals from the plurality of satellites 23. Then, the positioning reception controller 65, based on the received plurality of satellite signals, performs positioning reception processing for positioning. Computation of a reception position from a plurality of pieces of satellite orbital information is referred to as positioning. The time information correction controller 62 uses time information and current position information obtained by the positioning reception processing to correct the time data. In particular, the receiver 57 receives satellite signals from three or more number of the satellites 23.

The reception determining controller 66 is provided with a function of determining whether the reception of the GPS time information and the correction of the time data succeed or not. For example, during the time keeping reception processing, the reception determining controller 66 compares the GPS time information obtained from the received satellite signal with the time data. When a difference between the GPS time information of the satellite signal and the time data is large, processing is performed to prevent erroneous correction.

In addition, the controller 49 includes a detector 67. When the first button 19 or the second button 21 is pressed, the detector 67 detects that the first button 19 or the second button 21 is pressed. The detector 67 stores time in the memory 51 as reception time. Subsequently, the time keeping reception or the positioning reception is performed.

The day after the time keeping reception or the positioning reception is performed, the detector 67 checks time, until the time reaches the reception time. When the time reaches the reception time, the detector 67 outputs an instruction signal for starting the time keeping reception to the time keeping reception controller 64. When the light sensor 40 detects intense light before the time reaches the reception time after midnight, an instruction signal for starting the time keeping reception is outputted to the time keeping reception controller 64. Automatic reception conditions include that time reaches reception time, and that the light sensor 40 detects intense light. When the detector 67 detects that the automatic reception condition is satisfied, the time keeping reception controller 64 performs the time keeping reception.

Figure 4:
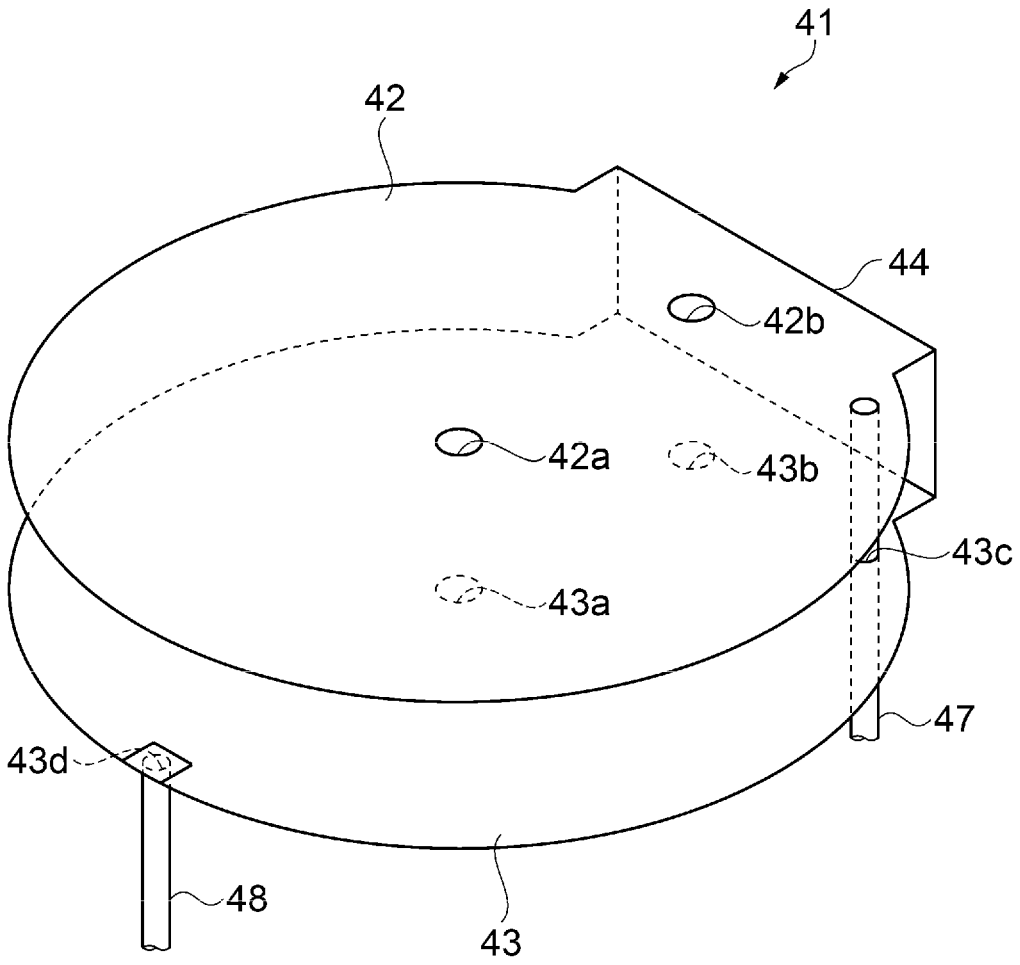
FIG. 4 is a schematic perspective view illustrating structure of a planar inverted-F antenna.
Figure 5:
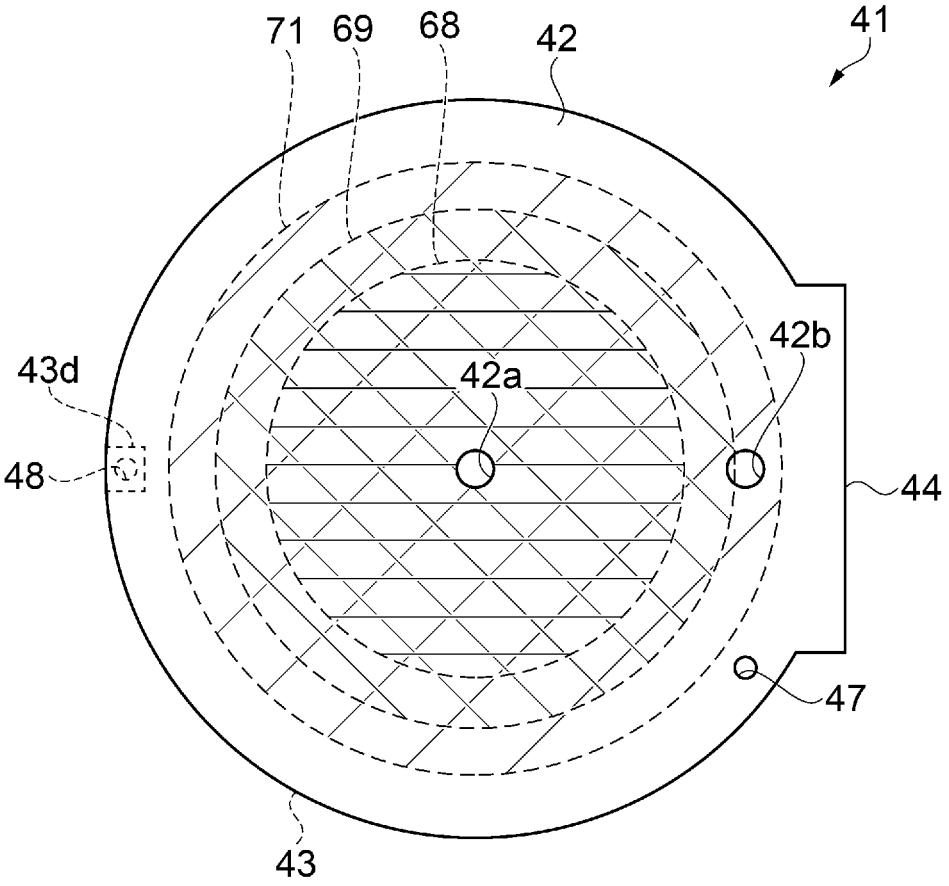
FIG. 5 is a schematic plan diagram illustrating the structure of the planar inverted-F antenna.

FIG. 4 is a schematic perspective view illustrating structure of the planar inverted-F antenna. FIG. 5 is a schematic plan diagram illustrating the structure of the planar inverted-F antenna. As illustrated in FIG. 2, FIG. 4, and FIG. 5, the planar inverted-F antenna 41 includes the planar first conductor element 42, the second conductor element 43 and the short-circuit portion 44 that are planar.

The first conductor element 42 is disposed so as to overlap with the second conductor element 43. The short-circuit portion 44 short-circuits the first conductor element 42 with the second conductor element 43. The first conductor element 42 is conducted to the receiver 57 mounted on the printed wired board 46 via the feed element 47. The second conductor element 43 is conducted to a ground terminal of the printed wired board 46 via the coupling element 48.

The first conductor element 42 and the second conductor element 43 are each formed as disk-shaped that is one size smaller than the dial 3. In plan view, a first through-hole 42*a* through which the hour hand shaft 7, the minute hand shaft 8, and the seconds hand shaft 9 are inserted is formed at a center position of the first conductor element 42. A second through-hole 42*b* for passing light through the light sensor 40 is formed in the first conductor element 42 on a side of the short-circuit portion 44.

In plan view, a third through-hole 43*a* through which the hour hand shaft 7, the minute hand shaft 8, and the seconds hand shaft 9 are inserted is formed at a center position of the second conductor element 43. A fourth through-hole 43*b* for passing light through the light sensor 40 is formed in the second conductor element 43 on a side of the short-circuit portion 44. A fifth through-hole 43*c* through which the feed element 47 is inserted is formed in the second conductor element 43, and a ground terminal 43*d* to which the coupling element 48 is coupled is formed at the second conductor element 43.

As described above, the fifth through-hole 43*c* and the like are provided in or on the second conductor element 43, and the first conductor element 42 and the second conductor element 43 are not members that are completely identical in shape and area. It is sufficient that the first conductor element 42 and the second conductor element 43 are disposed so as to function as the planar inverted-F antenna 41. Note that, in the planar inverted-F antenna 41, the second conductor element 43 serving as a ground electrode may be configured to be one size larger than the first conductor element 42 serving as a radiation electrode, and a position of an outer periphery of the first conductor element 42 may be disposed on an inner side than an outer periphery of the second conductor element 43.

The first conductor element 42 or the second conductor element 43 may be provided with a hole for keeping away from other components, or projections and depressions on an outer periphery for attachment. The above structure may be adopted to configure such that respective parts of the first conductor element 42 and the second conductor element 43 do not overlap with each other in plan view. In other words, as long as the first conductor element 42 overlaps with the second conductor element 43 as a whole, the planar inverted-F antenna 41 functions even when respective parts of the first conductor element 42 and the second conductor element 43 do not overlap with each other.

The first conductor element 42 is disposed on the front surface side of the main plate 32, and the second conductor element 43 is disposed on the rear surface side of the main plate 32. The first conductor element 42 and the second conductor element 43 are disposed so as to be separated from each other in a vertical direction by a thickness dimension of the main plate 32. In the axial direction of the hour hand shaft 7, a distance 50 between the hour hand 4 closest to the first conductor element 42, and the first conductor element 42 is set to be equal to or larger than 1.35 mm.

The short-circuit portion 44 is provided at respective outer edges of the first conductor element 42 and the second conductor element 43. The short-circuit portion 44 may be provided at one place, or may be provided at a plurality of places. The first conductor element 42, the second conductor element 43, and the short-circuit portion 44 are each formed of a sheet of metal such as copper, a copper alloy, aluminum, or an aluminum alloy.

The feed element 47 is coupled to a power supply terminal provided on the printed wired board 46. Signals received by the first conductor element 42 and the second conductor element 43 are supplied to the receiver 57 in which the feed element 47 is mounted on the printed wired board 46. The coupling element 48 couples the ground terminal provided on the printed wired board 46 with the ground terminal 43*d* provided on the second conductor element 43.

In FIG. 5, a first range 68 is a rotation range of the first conductive portion 4*a* in plan view when viewed from a direction parallel to the hour hand shaft 7. A third range 69 is a rotation range of the third conductive portion 5*a*. A second range 71 is a rotation range of the second conductive portion 6*a*. The planar inverted-F antenna 41 is also disposed at a position overlapping with the first range 68 and the second range 71.

Next, hand moving control during a reception process of a satellite signal in the watch 1 will be described. The reception process of a satellite signal performed by the watch 1 includes the manual reception processing and automatic reception processing. The first button 19 and the second button 21 each accept an instruction for the manual reception. The reception process for receiving a satellite signal when the operator presses the first button 19 or the second button 21 is the manual reception process. The manual reception processing includes the positioning reception processing and the time keeping reception processing. The positioning reception processing is processing for capturing three or more number of the satellites 23 to receive satellite signals, obtaining time information, and additionally calculating positional information. The time keeping reception processing is processing for capturing one or more number of the satellites 23 to receive satellite signals, and obtaining time information.

When the operator presses the first button 19, the positioning reception processing is selected. When the operator presses the second button 21, the time keeping reception processing is selected.

In the automatic reception processing, the detector 67 detects that a predetermined automatic reception condition is satisfied. Then, a satellite signal is automatically received. In the automatic reception processing, the time keeping reception processing is performed.

Alternatively, for example, any of the positioning reception processing and the time keeping reception processing may be selected depending on time during which the operator continues to press the first button 19.

Figure 6:
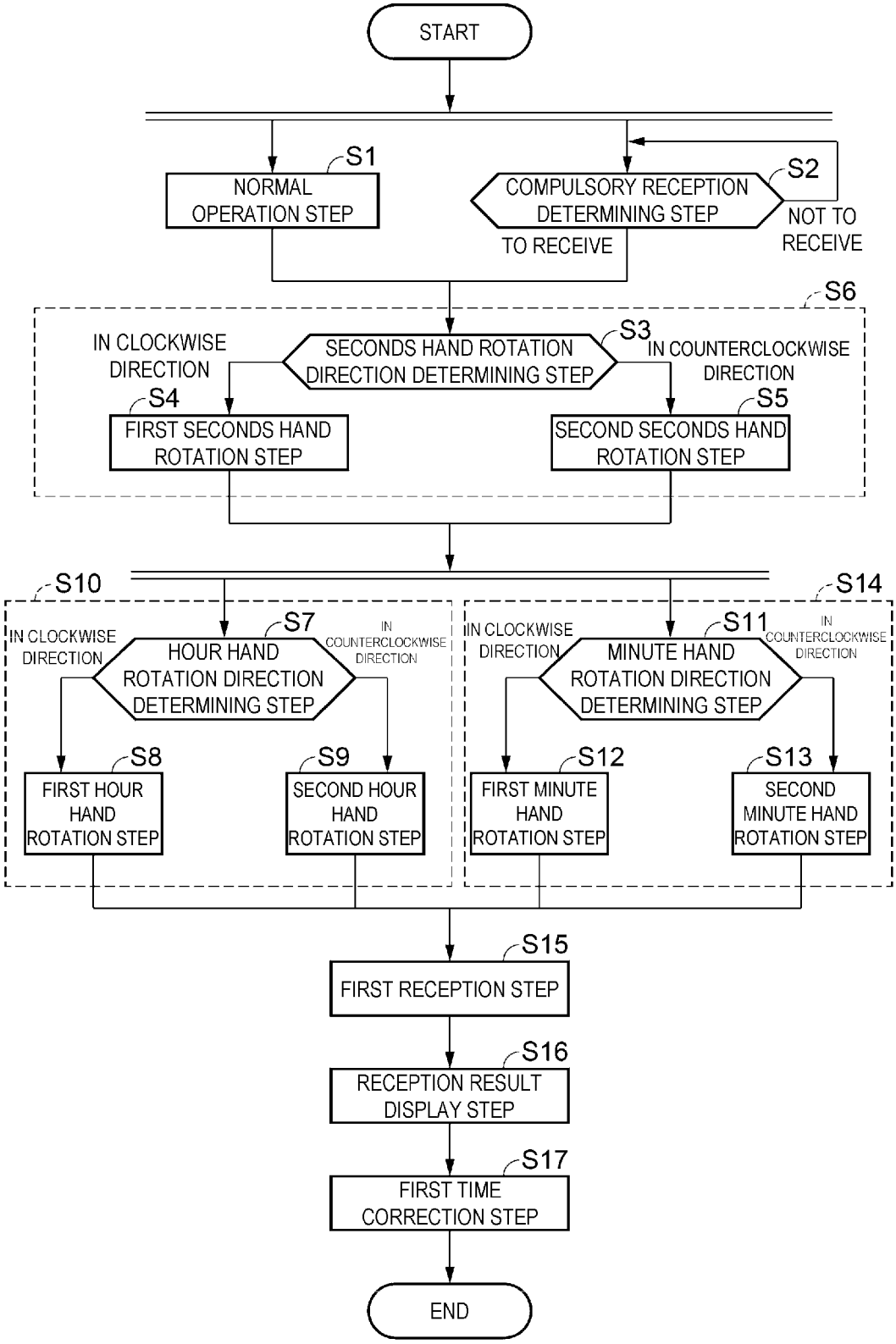
FIG. 6 is a flowchart of a method for controlling manual reception processing.

Next, a method for controlling the manual reception processing will be described. FIG. 6 is a flowchart of the method for controlling the manual reception processing. Step S1 is a normal operation step. This step is a step in which the display controller 61 controls the first motor 52, the second motor 54, and the third motor 39, and the hour hand 4, the minute hand 5, and the seconds hand 6 display current time. Next, the processing transits to step S3.

Step S2 is a manual reception determining step. In this step, the detector 67 detects whether or not the first button 19 or the second button 21 is pressed. When the detector 67 detects that the first button 19 or the second button 21 is pressed, the reception mode controller 63 determines to receive a satellite signal. When the detector 67 detects that the first button 19 and the second button 21 are not pressed, the reception mode controller 63 determines not to receive a satellite signal.

When the first button 19 is pressed, the reception mode controller 63 determines to perform the positioning reception processing. When the second button 21 is pressed, the reception mode controller 63 determines to perform the time keeping reception processing. When the reception mode controller 63 determines to receive a satellite signal, the processing transits to step S3 next. When the reception mode controller 63 determines not to receive a satellite signal, step S2 continues.

Step S1 and step S2 are performed in parallel. When the processing transits from step S2 to step S3, transition from step S1 to step S3 is also performed simultaneously.

Step S3 is a seconds hand rotation direction determining step. This step is a step of determining whether to rotate the seconds hand 6 in a clockwise direction or to rotate in a counterclockwise direction. A destination of the seconds hand 6 when the positioning reception processing is performed is the first position 12. Time taken for the seconds hand 6 to move from a current position to a destination is defined as seconds hand moving time. In the positioning reception processing, the display controller 61 calculates which of the clockwise direction and the counterclockwise direction shortens the seconds hand moving time. When the seconds hand moving time is shorter in the clockwise direction than in the counterclockwise direction, the display controller 61 determines to rotate the seconds hand 6 clockwise. When the seconds hand moving time is shorter in the counterclockwise direction than in the clockwise direction, the display controller 61 determines to rotate the seconds hand 6 counterclockwise. Note that, the determination may be made depending on an angle from the current position to the destination of the seconds hand 6.

A destination of the seconds hand 6 when the time keeping reception processing is performed is the second position 13. The seconds hand moving time is time taken for the seconds hand 6 to move from the current position to the second position 13. In the time keeping reception processing, the display controller 61 calculates which of the clockwise direction and the counterclockwise direction shortens the seconds hand moving time. When the seconds hand moving time is shorter in the clockwise direction than in the counterclockwise direction, the display controller 61 determines to rotate the seconds hand 6 clockwise. When the seconds hand moving time is shorter in the counterclockwise direction than in the clockwise direction, the display controller 61 determines to rotate the seconds hand 6 counterclockwise. Note that, the determination may be made depending on an angle from the current position to the destination of the seconds hand 6.

When the display controller 61 determines to rotate the seconds hand 6 clockwise, the processing transits to step S4 next. When the display controller 61 determines to rotate the seconds hand 6 counterclockwise, the processing transits to step S5 next.

Step S4 is a first seconds hand rotation step. In this step, the display controller 61 controls the third motor 39 and rotates the seconds hand 6 clockwise. When the positioning reception processing is performed, the display controller 61 makes the seconds hand 6 point the first position 12. The first position 12 is a position indicating that the positioning reception processing is performed. When the time keeping reception processing is performed, the display controller 61 makes the seconds hand 6 point the second position 13. The second position 13 is a position indicating that the time keeping reception processing is performed. Next, the processing transits to step S7 and step S11. Step S7 and step S11 are performed in parallel.

Step S5 is a second seconds hand rotation step. In this step, the display controller 61 controls the third motor 39 and rotates the seconds hand 6 counterclockwise. When the positioning reception processing is performed, the display controller 61 makes the seconds hand 6 point the first position 12. When the time keeping reception processing is performed, the display controller 61 makes the seconds hand 6 point the second position 13. Next, the processing transits to step S7 and step S11. Step S7 and step S11 are performed in parallel. Step S3, step S4, and step S5 are collectively referred to as a seconds hand rotation step in step S6. After the seconds hand 6 reaches the first position 12 or the second position 13, step S7 and step S11 are performed. Note that, step S3 and step S5 may be omitted when the seconds hand 6 is constantly rotated clockwise.

Step S7 is an hour hand rotation direction determining step. This step is a step of determining whether to rotate the hour hand 4 in the clockwise direction or to rotate in the counterclockwise direction. A destination of the hour hand 4 when the positioning reception processing is performed is the first position 12. Time taken for the hour hand 4 to move from a current position to a destination is defined as hour hand moving time. In the positioning reception processing, the display controller 61 calculates which of the clockwise direction and the counterclockwise direction shortens the hour hand moving time. When the hour hand moving time is shorter in the clockwise direction, the display controller 61 determines to rotate the hour hand 4 clockwise. When the hour hand moving time is shorter in the counterclockwise direction, the display controller 61 determines to rotate the hour hand 4 counterclockwise. Note that, the determination may be made depending on an angle from the current position to the destination of the hour hand 4.

A destination of the hour hand 4 when the time keeping reception processing is performed is the second position 13. The hour hand moving time is time taken for the hour hand 4 to move from the current position to the second position 13. In the time keeping reception processing, the display controller 61 calculates which of the clockwise direction and the counterclockwise direction shortens the hour hand moving time. When the hour hand moving time is shorter in the clockwise direction, the display controller 61 determines to rotate the hour hand 4 clockwise. When the hour hand moving time is shorter in the counterclockwise direction, the display controller 61 determines to rotate the hour hand 4 counterclockwise. Note that, the determination may be made depending on an angle from the current position to the destination of the hour hand 4.

When the display controller 61 determines to rotate the hour hand 4 clockwise, the processing transits to step S8 next. When the display controller 61 determines to rotate the hour hand 4 counterclockwise, the processing transits to step S9 next.

Step S8 is a first hour hand rotation step. In this step, the display controller 61 controls the first motor 52 and rotates the hour hand 4 clockwise. When the positioning reception processing is performed, the display controller 61 makes the hour hand 4 point the first position 12. When the time keeping reception processing is performed, the display controller 61 makes the hour hand 4 point the second position 13. Next, the processing transits to step S15.

Step S9 is a second hour hand rotation step. In this step, the display controller 61 controls the first motor 52 and rotates the hour hand 4 counterclockwise. When the positioning reception processing is performed, the display controller 61 makes the hour hand 4 point the first position 12. When the time keeping reception processing is performed, the display controller 61 makes the hour hand 4 point the second position 13. Next, the processing transits to step S15. Step S7, step S8, and step S9 are collectively referred to as an hour hand rotation step in step S10.

Step S11 is a minute hand rotation direction determining step. This step is a step of determining whether to rotate the minute hand 5 in the clockwise direction or to rotate in the counterclockwise direction. A destination of the minute hand 5 when the positioning reception processing is performed is the first position 12. Time taken for the minute hand 5 to move from a current position to a destination is defined as minute hand moving time. In the positioning reception processing, the display controller 61 calculates which of the clockwise direction and the counterclockwise direction shortens the minute hand moving time. When the minute hand moving time is shorter in the clockwise direction than in the counterclockwise direction, the display controller 61 determines to rotate the minute hand 5 clockwise. When the minute hand moving time is shorter in the counterclockwise direction than in the clockwise direction, the display controller 61 determines to rotate the minute hand 5 counterclockwise. Note that, the determination may be made depending on an angle from the current position to the destination of the minute hand 5.

A destination of the minute hand 5 when the time keeping reception processing is performed is the second position 13. The minute hand moving time is time taken for the minute hand 5 to move to the second position 13. In the time keeping reception processing, the display controller 61 calculates which of the clockwise direction and the counterclockwise direction shortens the minute hand moving time. When the minute hand moving time is shorter in the clockwise direction than in the counterclockwise direction, the display controller 61 determines to rotate the minute hand 5 clockwise. When the minute hand moving time is shorter in the counterclockwise direction than in the clockwise direction, the display controller 61 determines to rotate the minute hand 5 counterclockwise. Note that, the determination may be made depending on an angle from the current position to the destination of the minute hand 5.

When the display controller 61 determines to rotate the minute hand 5 clockwise, the processing transits to step S12 next. When the display controller 61 determines to rotate the minute hand 5 counterclockwise, the processing transits to step S13 next.

Step S12 is a first minute hand rotation step. In this step, the display controller 61 controls the second motor 54 and rotates the minute hand 5 clockwise. When the positioning reception processing is performed, the display controller 61 makes the minute hand 5 point the first position 12. When the time keeping reception processing is performed, the display controller 61 makes the minute hand 5 point the second position 13. Next, the processing transits to step S15.

Step S13 is a second minute hand rotation step. In this step, the display controller 61 controls the second motor 54 and rotates the minute hand 5 counterclockwise. When the positioning reception processing is performed, the display controller 61 makes the minute hand 5 point the first position 12. When the time keeping reception processing is performed, the display controller 61 makes the minute hand 5 point the second position 13. Next, the processing transits to step S15. Step S11, step S12, and step S13 are collectively referred to as a minute hand rotation step in step S14.

Step S15 is a first reception step. Step S15 is performed in a state in which the first conductive portion 4*a* and the third conductive portion 5*a* and the second conductive portion 6*a* overlap with each other. When performing the positioning reception processing, the positioning reception controller 65 actuates the receiver 57 to start reception processing of a satellite signal. The positioning reception controller 65 transmits the number of satellite signals received by the receiver 57 to the display controller 61. The display controller 61 simultaneously rotates the hour hand 4, the minute hand 5, and the seconds hand 6. Then, the display controller 61 makes the hour hand 4, the minute hand 5, and the seconds hand 6 display the number of the satellite signals received by the receiver 57. When time information and current position information can be obtained in the positioning reception processing, the positioning reception controller 65 outputs coordinate universal time obtained by correcting obtained GPS time with leap seconds information to the time information correction controller 62. Next, the processing transits to step S16.

When performing the time keeping reception processing, the time keeping reception controller 64 actuates the receiver 57 to start the reception processing of a satellite signal. The time keeping reception controller 64 transmits strength of a radio wave received by the receiver 57 to the display controller 61. The display controller 61 simultaneously rotates the hour hand 4, the minute hand 5, and the seconds hand 6. Then, the display controller 61 makes the hour hand 4, the minute hand 5, and the seconds hand 6 display the strength of the radio wave received by the receiver 57. When time information can be obtained in the time keeping reception processing, the time keeping reception controller 64 outputs the obtained time information to the time information correction controller 62. Next, the processing transits to step S16.

Step S16 is a reception result display step. In this step, the display controller 61 simultaneously rotates the hour hand 4, the minute hand 5, and the seconds hand 6. Then, the display controller 61 makes the hour hand 4, the minute hand 5, and the seconds hand 6 display whether or not the time keeping reception processing or the positioning reception processing succeeds. In the positioning reception processing, when the receiver 57 is unable to capture three or more number of the satellites 23, or when signal strength of a radio wave is weak and thus the positioning reception controller 65 determines that positional information cannot be calculated, the positioning reception processing fails.

In the time keeping reception processing, when strength of a radio wave of a satellite signal is weak and the time keeping reception controller 64 determines that time information cannot be calculated, the time keeping reception processing fails. Next, the processing transits to step S17.

Step S17 is a first time correction step. This step is a step in which the time information correction controller 62 corrects time. The time information correction controller 62 calculates time difference information based on a current position from the positional information obtained in the positioning reception processing. Local time is calculated from the coordinate universal time obtained from the satellite signal received by the receiver 57 and the time difference information, and is transmitted to the display controller 61. In the time keeping reception processing, local time is corrected from the received time, and is transmitted to the display controller 61. The display controller 61 drives the drive mechanism 60 to make the hour hand 4, the minute hand 5, and the seconds hand 6 display the time. Then the processing returns to normal hand moving. With the above steps, the hand moving control during the manual reception processing ends.

In this manner, when the first button 19 or the second button 21 accepts an instruction for the manual reception, the display controller 61 overlaps the first conductive portion 4*a* and the third conductive portion 5*a* and the second conductive portion 6*a* with each other in plan view, and the planar inverted-F antenna 41 receives a radio wave.

FIG. 7 to FIG. 17 are diagrams for explaining hand moving control during reception processing of a satellite signal in the manual reception. Next, with reference to FIG. 7 to FIG. 17, while associating with the steps illustrated in FIG. 6, the hand moving control during the reception processing of a satellite signal in the manual reception will be described in detail. First, with reference to FIG. 7 to FIG. 12, the hand moving control of the time keeping reception processing will be described.

Figure 7:
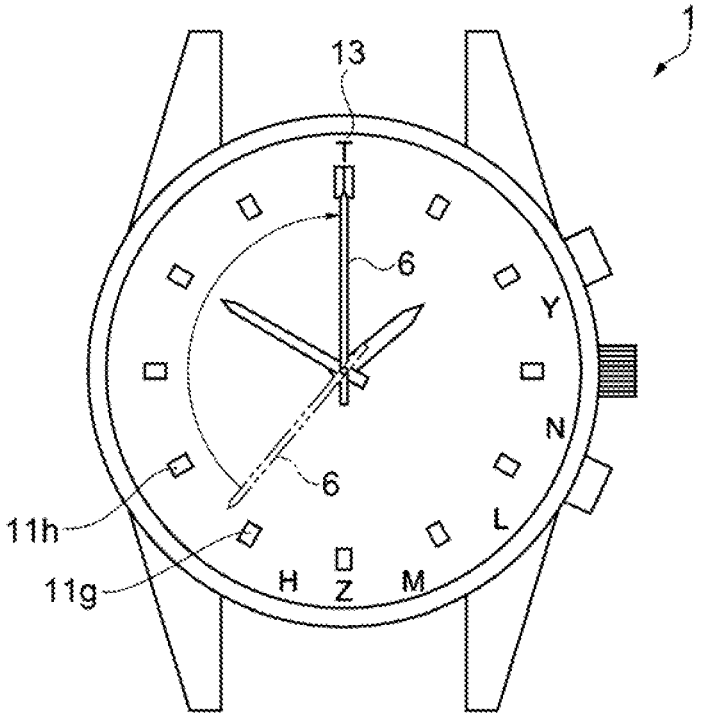
FIG. 7 is a diagram for explaining hand moving control during the manual reception processing.

FIG. 7 is a diagram corresponding to the seconds hand rotation step in step S6. As illustrated in FIG. 7, the seconds hand 6 points between the seventh indicator 11*g* and the eighth indicator 11*h*. The display controller 61 moves the seconds hand 6 to the second position 13. In the seconds hand rotation direction determining step in step S3, the display controller 61 determines that the seconds hand moving time is shorter in the clockwise direction than in the counterclockwise direction. Then, in the first seconds hand rotation step in step S4, the display controller 61 rotates the seconds hand 6. The display controller 61 controls a position of the seconds hand 6 such that the seconds hand 6 points the second position 13.

Figure 8:
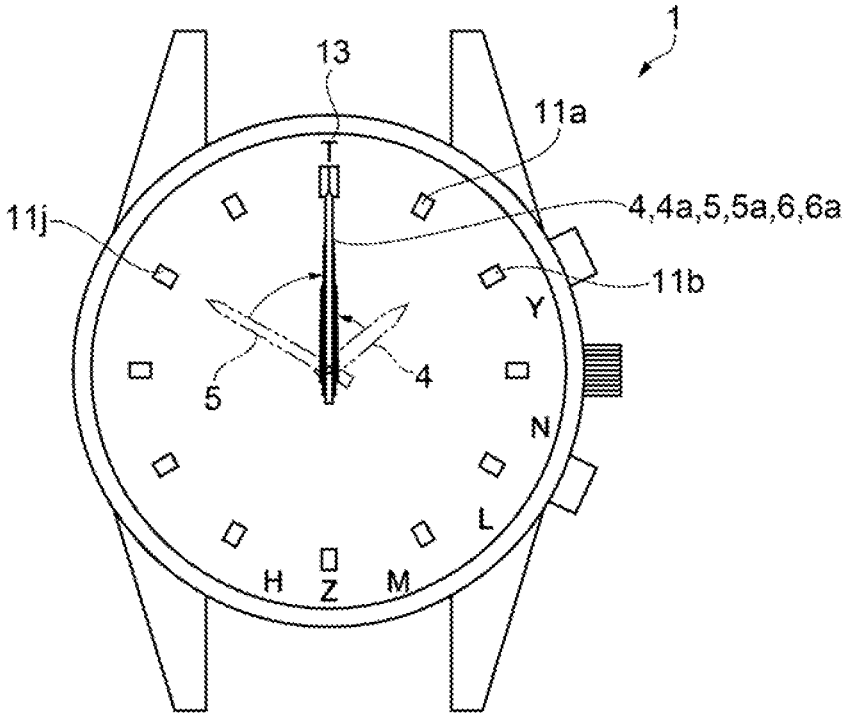
FIG. 8 is a diagram for explaining the hand moving control during the manual reception processing.
Figure 9:
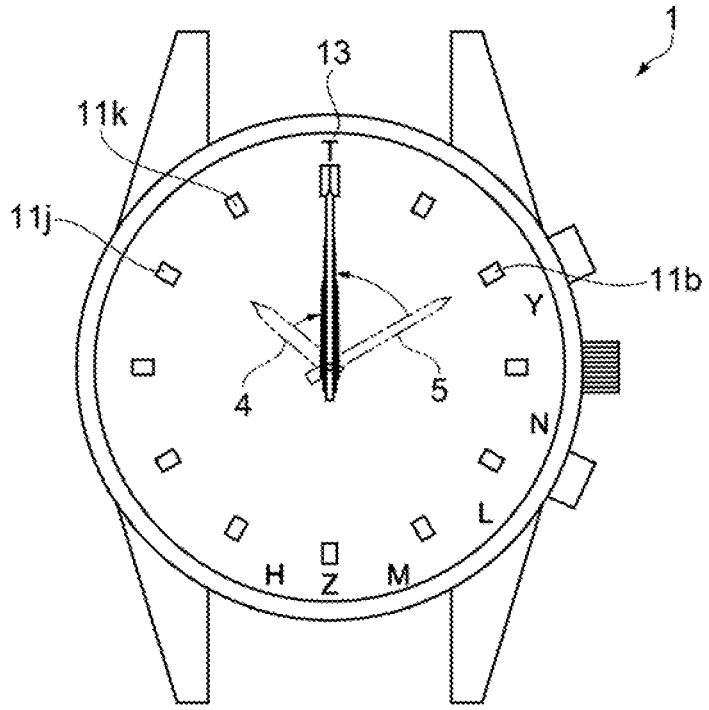
FIG. 9 is a diagram for explaining the hand moving control during the manual reception processing.

FIG. 8 and FIG. 9 are diagrams corresponding to the hour hand rotation step in step S10 and the minute hand rotation step in step S14. As illustrated in FIG. 8, the hour hand 4 points between the first indicator 11*a* and the second indicator 11*b*. In the hour hand rotation direction determining step in step S7, the display controller 61 determines that the hour hand moving time is shorter in the counterclockwise direction than in the clockwise direction. Then, in the second hour hand rotation step in step S9, the display controller 61 rotates the hour hand 4. The display controller 61 controls the position of the hour hand 4 such that the hour hand 4 points the second position 13.

The minute hand 5 points the tenth indicator 11*j*. In the minute hand rotation direction determining step in step S11, the display controller 61 determines that the minute hand moving time is shorter in the clockwise direction than in the counterclockwise direction. Then, in the first minute hand rotation step in step S12, the display controller 61 rotates the minute hand 5.

The display controller 61 controls the position of the minute hand 5 such that the minute hand 5 points the second position 13. At this time, the first conductive portion 4*a*, the third conductive portion 5*a*, and the second conductive portion 6*a* overlap with each other.

In FIG. 9, the hour hand 4 points between the tenth indicator 11*j* and the eleventh indicator 11*k*. In the hour hand rotation direction determining step in step S7, the display controller 61 determines that the hour hand moving time is shorter in the clockwise direction than in the counterclockwise direction. Then, in the first hour hand rotation step in step S8, the display controller 61 rotates the hour hand 4. The display controller 61 controls the position of the hour hand 4 such that the hour hand 4 points the second position 13.

The minute hand 5 points the second indicator 11*b*. In the minute hand rotation direction determining step in step S11, the display controller 61 determines that the minute hand moving time is shorter in the counterclockwise direction than in the clockwise direction. Then, in the second minute hand rotation step in step S13, the display controller 61 rotates the minute hand 5. The display controller 61 controls the position of the minute hand 5 such that the minute hand 5 points the second position 13. At this time, the first conductive portion 4*a*, the third conductive portion 5*a*, and the second conductive portion 6*a* overlap with each other.

As described above, when the planar inverted-F antenna 41 receives a radio wave, the display controller 61, after rotating the seconds hand 6 and stopping the seconds hand 6 at the second position 13, rotates the hour hand 4 and the minute hand 5, and overlaps the first conductive portion 4*a*, the third conductive portion 5*a*, and the second conductive portion 6*a* with each other in plan view.

At this time, an area where the first conductive portion 4*a*, the second conductive portion 6*a*, and the third conductive portion 5*a* overlap with the planar inverted-F antenna 41 in plan view is minimized. Thus, stray capacitance between the first conductive portion 4*a*, the second conductive portion 6*a*, and the third conductive portion 5*a*, and the planar inverted-F antenna 41 is also minimized. Note that, when at least the first conductive portion 4*a*, the second conductive portion 6*a*, and the third conductive portion 5*a* partially overlap with each other, the stay capacitance between the first conductive portion 4*a*, the second conductive portion 6*a*, and the third conductive portion 5*a*, and the planar inverted-F antenna 41 can also be reduced. Thus, the overlap of the conductive portions need not be complete overlap, and it is sufficient that at least the conductive portions partially overlap with each other. In particular, it has been found from experiments that a rate of improvement in antenna gain increases, when a percentage of an area where the conductive portions of the respective pointers overlap with each other nearly approaches 60%. Thus, it is desirable that equal to or larger than 60% of a plane area of the third conductive portion 5*a* of the minute hand 5 overlaps with the first conductive portion 4*a* of the hour hand 4, and equal to or larger than 60% of a plane area of the second conductive portion 6*a* of the seconds hand 6 overlaps with the third conductive portion 5*a* of the minute hand 5. Then, the display controller 61 moves the seconds hand 6 to stop the seconds hand 6 at the second position 13. The operator knows that the planar inverted-F antenna 41 receives a radio wave since the stop position of the seconds hand 6 is the second position 13.

A rotational speed of the seconds hand 6 is faster than that of the hour hand 4. Thus, when the first conductive portion 4*a* and the third conductive portion 5*a* and the second conductive portion 6*a* are overlapped with each other, compared to when the display controller 61 moves the hour hand 4 at first to the second position 13, there is a high probability of the seconds hand 6 reaching the second position 13 in a short period of time when the display controller 61 moves the seconds hand 6 at first to the second position 13. Thus, according to the structure of the watch 1 and the method for controlling the watch 1, in a case in which the first conductive portion 4*a* and the third conductive portion 5*a* and the second conductive portion 6*a* are overlapped with each other when a radio wave is received, the display controller 61 can quickly notify the operator that the planar inverted-F antenna 41 receives a radio wave.

When the watch 1 receives a radio wave and detects time, the display controller 61 overlaps the first conductive portion 4*a* and the third conductive portion 5*a* and the second conductive portion 6*a* with each other at the second position 13. When the first conductive portion 4*a* and the third conductive portion 5*a* and the second conductive portion 6*a* overlap with each other at the second position 13, the operator can know that the controller 49 detects time.

After the first conductive portion 4*a* and the third conductive portion 5*a* and the second conductive portion 6*a* are overlapped with each other in plan view, reception of a radio wave is performed by the planar inverted-F antenna 41. The area where the first conductive portion 4*a*, the third conductive portion 5*a*, and the second conductive portion 6*a* overlap with the planar inverted-F antenna 41 is small. Thus, the planar inverted-F antenna 41 can receive a radio wave with good sensitivity.

A material of the hour hand shaft 7, the minute hand shaft 8, and the seconds hand shaft 9 is a conductive metal. At this time, currents flow through the hour hand shaft 7, the minute hand shaft 8, the seconds hand shaft 9, the first conductive portion 4*a*, the third conductive portion 5*a*, and the second conductive portion 6*a*. There is a possibility that influence of parasitic capacitance occurring between the first conductor element 42 and the first conductive portion 4*a*, the third conductive portion 5*a*, and the second conductive portion 6*a* increases, shifting of a resonant frequency occurs, and reception sensitivity decreases.

Since an area of the first conductive portion 4*a*, the third conductive portion 5*a*, and the second conductive portion 6*a* that faces the first conductor element 42 is minimized, the parasitic capacitance occurring between the first conductive portion 4*a*, the third conductive portion 5*a*, and the second conductive portion 6*a*. and the first conductor element 42 is also minimized. The shifting of the resonant frequency in the planar inverted-F antenna 41 due to the influence of the parasitic capacitance is reduced, and the decrease in reception sensitivity can also be suppressed to be minimum.

Figure 10:
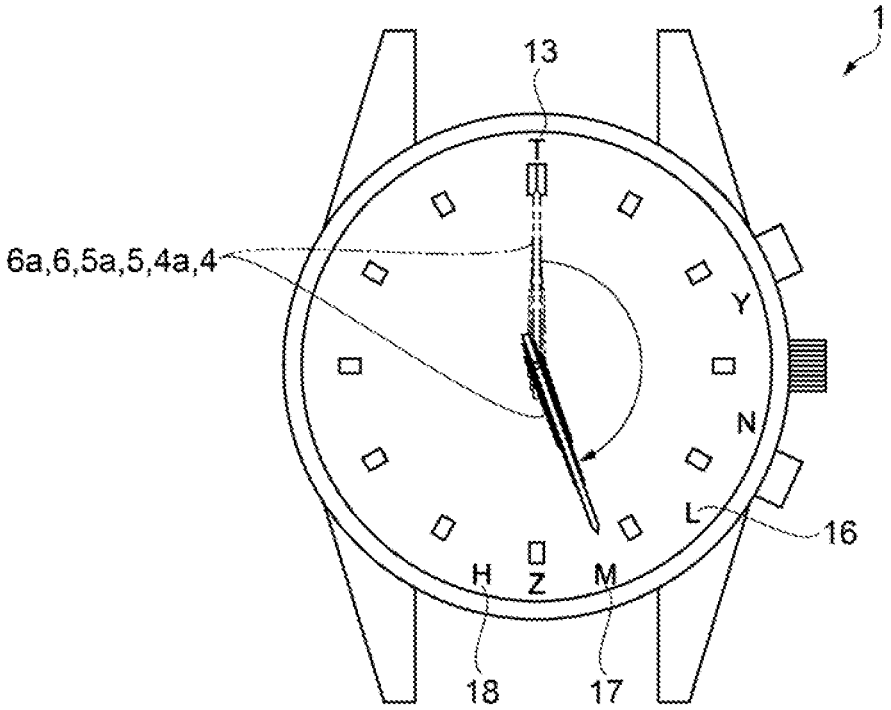
FIG. 10 is a diagram for explaining the hand moving control during the manual reception processing.

FIG. 10 is a diagram corresponding to the first reception step in step S15. As illustrated in FIG. 10, the display controller 61 simultaneously rotates the hour hand 4, the minute hand 5, and the seconds hand 6. Then, the display controller 61 makes the hour hand 4, the minute hand 5, and the seconds hand 6 display the strength of the radio wave received by the receiver 57. The fifth position 16, the sixth position 17, and the seventh position 18 each displaying strength of a radio wave are set on the dial 3. When strength of a radio wave received by the receiver 57 is strong, the hour hand 4, the minute hand 5, and the seconds hand 6 point the seventh position 18. When strength of a radio wave received by the receiver 57 is moderate, the hour hand 4, the minute hand 5, and the seconds hand 6 point the sixth position 17. When strength of a radio wave received by the receiver 57 is weak, the hour hand 4, the minute hand 5, and the seconds hand 6 point the fifth position 16. When strength of a radio wave received by the receiver 57 is very weak, the hour hand 4, the minute hand 5, and the seconds hand 6 point the second position 13.

In this manner, the display controller 61, in a state in which the first conductive portion 4*a* and the third conductive portion 5*a* and the second conductive portion 6*a* overlap with each other in plan view, rotates the hour hand 4, the minute hand 5, and the seconds hand 6, and displays strength of a radio wave received by the planar inverted-F antenna 41. In a state in which the planar inverted-F antenna 41 easily receives a radio wave, the hour hand 4, the minute hand 5, and the seconds hand 6 can inform the operator of strength of a radio wave received by the planar inverted-F antenna 41.

Figure 11:
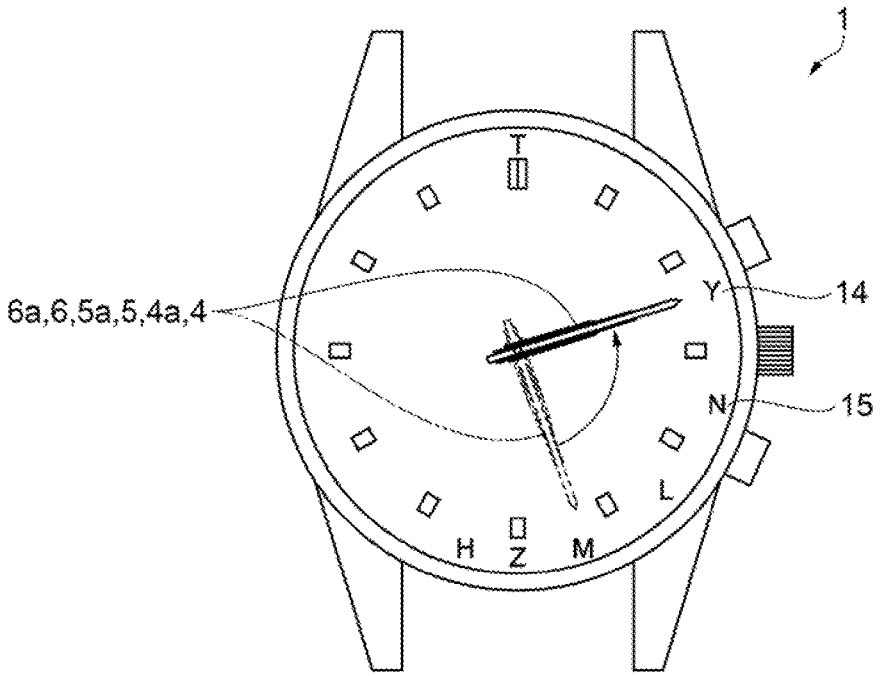
FIG. 11 is a diagram for explaining the hand moving control during the manual reception processing.

FIG. 11 is a diagram corresponding to the reception result display step in step S16. As illustrated in FIG. 11, the display controller 61 simultaneously rotates the hour hand 4, the minute hand 5, and the seconds hand 6. Then, the display controller 61 makes the hour hand 4, the minute hand 5, and the seconds hand 6 display a result of the time keeping reception processing. The third position 14 and the fourth position 15 each displaying the result of the time keeping reception processing are set on the dial 3. When the time keeping reception processing performed in the first reception step in step S15 is successful, the hour hand 4, the minute hand 5, and the seconds hand 6 point the third position 14. When the time keeping reception processing is not successful, the hour hand 4, the minute hand 5, and the seconds hand 6 point the fourth position 15. The operator can know whether the time keeping reception processing is successful or not, by checking the position pointed by the hour hand 4, the minute hand 5, and the seconds hand 6.

Figure 12:
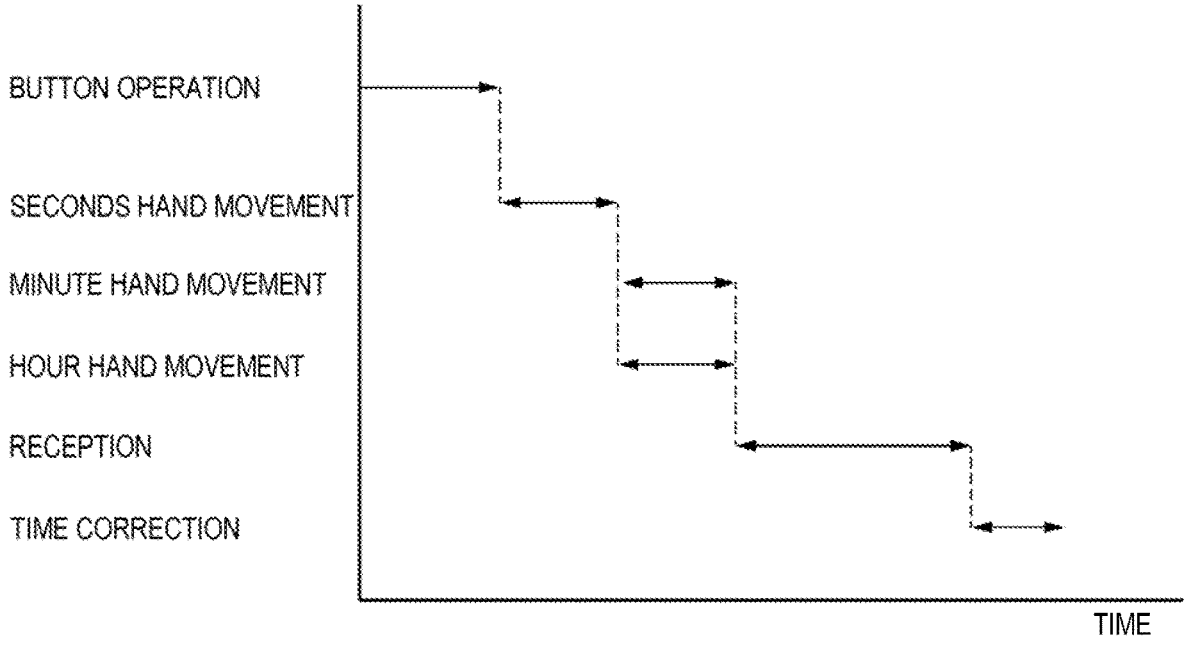
FIG. 12 is a diagram for explaining the hand moving control during the manual reception processing.

FIG. 12 is a time chart illustrating a procedure from step S2 to step S17. As illustrated in FIG. 12, a button operation is first performed in which the operator presses the second button 21. Next, the display controller 61 rotates the seconds hand 6. The seconds hand 6 points the second position 13. Next, the display controller 61 rotates the hour hand 4 and the minute hand 5 simultaneously. The hour hand 4 and the minute hand 5 point the second position 13. The receiver 57 receives a radio wave with the hour hand 4, the minute hand 5, and the seconds hand 6 overlapping with each other. The time keeping reception processing is performed. When the time keeping reception processing is successful, the time information correction controller 62 corrects time. Then, the display controller 61 makes the hour hand 4, the minute hand 5, and the seconds hand 6 display current time.

Next, with reference to FIG. 13 to FIG. 17, hand moving control of the positioning reception processing will be described.

Figure 13:
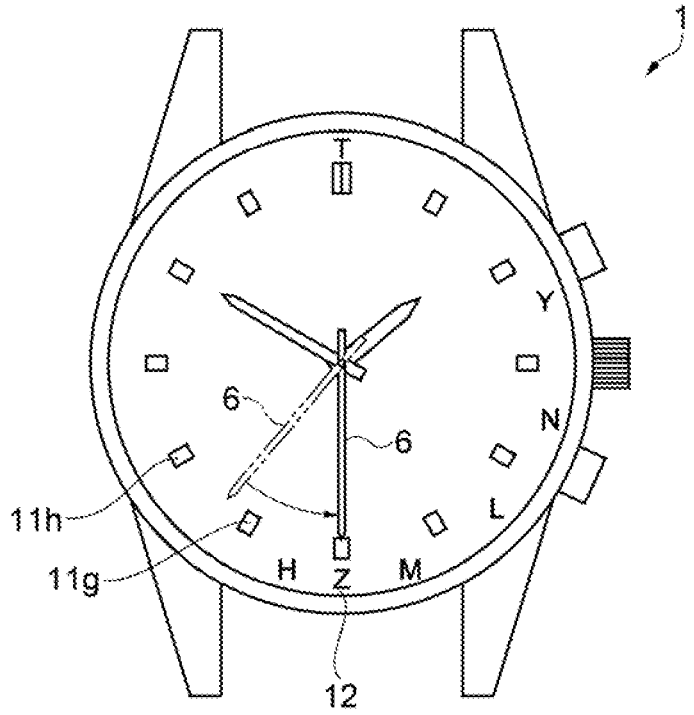
FIG. 13 is a diagram for explaining the hand moving control during the manual reception processing.

FIG. 13 is a diagram corresponding to the seconds hand rotation step in step S6. As illustrated in FIG. 13, the seconds hand 6 points between the seventh indicator 11*g* and the eighth indicator 11*h*. The display controller 61 moves the seconds hand 6 to the first position 12. In the seconds hand rotation direction determining step in step S3, the display controller 61 determines that the seconds hand moving time is shorter in the counterclockwise direction than in the clockwise direction. Then, in the second seconds hand rotation step in step S5, the display controller 61 rotates the seconds hand 6 counterclockwise. The display controller 61 controls the position of the seconds hand 6 such that the seconds hand 6 points the first position 12.

Figure 14:
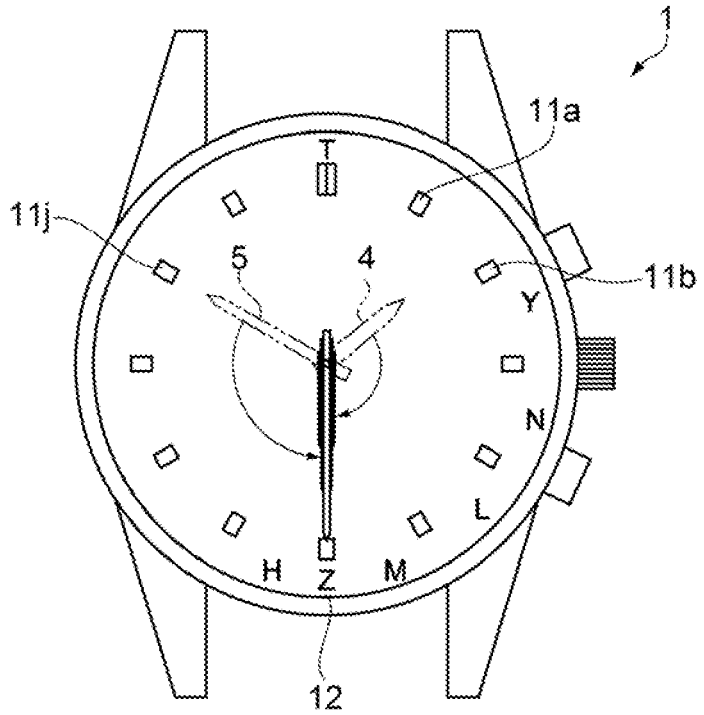
FIG. 14 is a diagram for explaining the hand moving control during the manual reception processing.
Figure 15:
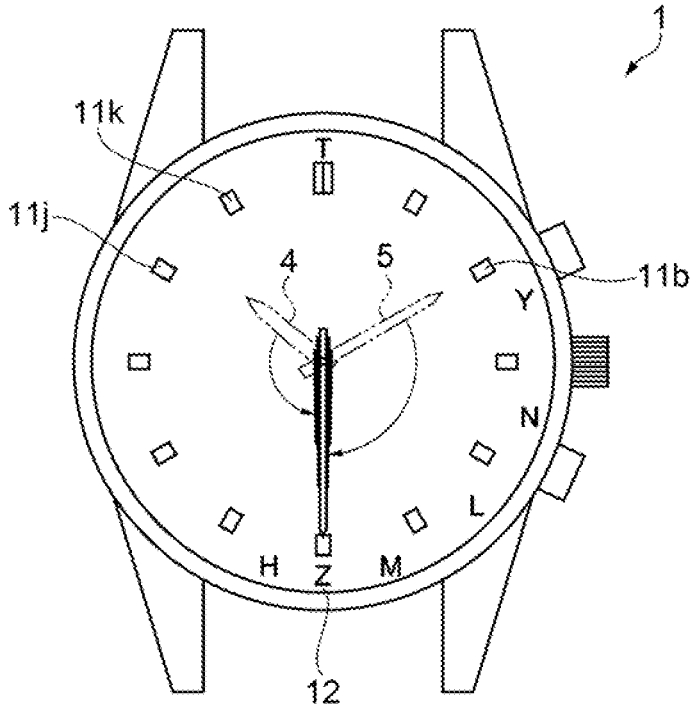
FIG. 15 is a diagram for explaining the hand moving control during the manual reception processing.

FIG. 14 and FIG. 15 are diagrams corresponding to the hour hand rotation step in step S10 and the minute hand rotation step in step S14. As illustrated in FIG. 14, the hour hand 4 points between the first indicator 11*a* and the second indicator 11*b*. In the hour hand rotation direction determining step in step S7, the display controller 61 determines that the hour hand moving time is shorter in the clockwise direction than in the counterclockwise direction. Then, in the first hour hand rotation step in step S8, the display controller 61 rotates the hour hand 4 clockwise. The display controller 61 controls the position of the hour hand 4 such that the hour hand 4 points the first position 12.

The minute hand 5 points the tenth indicator 11*j*. In the minute hand rotation direction determining step in step S11, the display controller 61 determines that the minute hand moving time is shorter in the counterclockwise direction than in the clockwise direction. Then, in the second minute hand rotation step in step S13, the display controller 61 rotates the minute hand 5 counterclockwise. The display controller 61 controls the position of the minute hand 5 such that the minute hand 5 points the first position 12. At this time, the first conductive portion 4*a*, the third conductive portion 5*a*, and the second conductive portion 6*a* overlap with each other.

In FIG. 15, the hour hand 4 points between the tenth indicator 11*j* and the eleventh indicator 11*k*. In the hour hand rotation direction determining step in step S7, the display controller 61 determines that the hour hand moving time is shorter in the counterclockwise direction than in the clockwise direction. Then, in the second hour hand rotation step in step S9, the display controller 61 rotates the hour hand 4 counterclockwise. The display controller 61 controls the position of the hour hand 4 such that the hour hand 4 points the first position 12.

The minute hand 5 points the second indicator 11*b*. In the minute hand rotation direction determining step in step S11, the display controller 61 determines that the minute hand moving time is shorter in the clockwise direction than in the counterclockwise direction. Then, in the first minute hand rotation step in step S12, the display controller 61 rotates the minute hand 5 clockwise. The display controller 61 controls the position of the minute hand 5 such that the minute hand 5 points the first position 12.

At this time, the first conductive portion 4*a*, the third conductive portion 5*a*, and the second conductive portion 6*a* overlap with each other.

As described above, when the planar inverted-F antenna 41 receives a radio wave, the display controller 61, after rotating the seconds hand 6 and stopping the seconds hand 6 at the first position 12 or the second position 13, rotates the hour hand 4 and the minute hand 5, and overlaps the first conductive portion 4*a*, the third conductive portion 5*a*, and the second conductive portion 6*a* with each other in plan view.

According to the configuration of and the method for controlling the watch 1, the rotational speed of the seconds hand 6 is faster than that of the hour hand 4. Thus, in the positioning reception processing as well, in the case in which the first conductive portion 4*a* and the third conductive portion 5*a* and the second conductive portion 6*a* are overlapped with each other when a radio wave is received, the watch 1 can quickly notify the operator that the planar inverted-F antenna 41 receives a radio wave. When the first conductive portion 4*a* and the third conductive portion 5*a* and the second conductive portion 6*a* overlap with each other at the first position 12, the operator can know that the controller 49 detects a position and corrects time.

In the positioning reception processing as well, the first conductive portion 4*a*, the third conductive portion 5*a*, and the second conductive portion 6*a* are overlapped with each other in plan view. The area where the first conductive portion 4*a*, the third conductive portion 5*a*, and the second conductive portion 6*a* overlap with the planar inverted-F antenna 41 is small. Thus, the planar inverted-F antenna 41 can receive a radio wave with good sensitivity.

When the watch 1 receives a radio wave and detects a position, the display controller 61 overlaps the first conductive portion 4*a* and the third conductive portion 5*a* and the second conductive portion 6*a* with each other at the first position 12. When the first conductive portion 4*a* and the third conductive portion 5*a* and the second conductive portion 6*a* overlap with each other at the first position 12, the operator can know that the positioning reception controller 65 detects a position.

Figure 16:
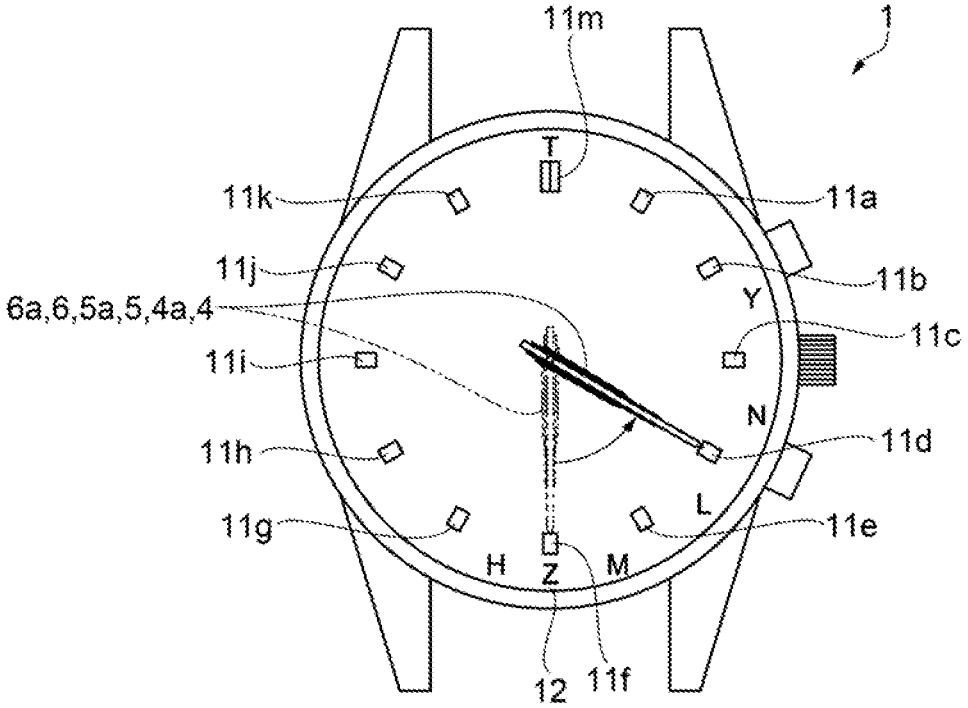
FIG. 16 is a diagram for explaining the hand moving control during the manual reception processing.

FIG. 16 is a diagram corresponding to the first reception step in step S15. As illustrated in FIG. 16, the display controller 61 simultaneously rotates the hour hand 4, the minute hand 5, and the seconds hand 6. Then, the display controller 61 makes the hour hand 4, the minute hand 5, and the seconds hand 6 display the number of the satellites 23 that the receiver 57 receives and captures. The first indicator 11*a* to the twelfth indicator 11*m* each displaying the number of the satellites 23 are set on the dial 3. When the number of the satellites 23 captured by the receiver 57 is zero, the hour hand 4, the minute hand 5, and the seconds hand 6 point the twelfth indicator 11*m*. When the number of the satellites 23 captured by the receiver 57 is one, the hour hand 4, the minute hand 5, and the seconds hand 6 point the first indicator 11*a*. When the number of the satellites 23 captured by the receiver 57 is two, the hour hand 4, the minute hand 5, and the seconds hand 6 point the second indicator lib. When the number of the satellites 23 captured by the receiver 57 is three to eleven, the third indicator 11*c* to the eleventh indicator 11*k* are pointed, respectively, by the hour hand 4, the minute hand 5, and the seconds hand 6 point. The figure illustrates a case in which the number of the satellites 23 captured by the receiver 57 is four, and the hour hand 4, the minute hand 5, and the seconds hand 6 point the fourth indicator 11*d*.

As described above, the display controller 61, in a state in which the third conductive portion 5*a*, the second conductive portion 6*a*, and the first conductive portion 4*a* overlap with each other in plan view, rotates the hour hand 4, the minute hand 5, and the seconds hand 6. Then, the number of the satellites 23 captured by the receiver 57 is displayed by the hour hand 4, the minute hand 5, and the seconds hand 6. In the state in which the planar inverted-F antenna 41 easily receives a radio wave, the hour hand 4, the minute hand 5, and the seconds hand 6 can inform the operator of the number of the satellites 23 captured by the receiver 57.

Figure 17:
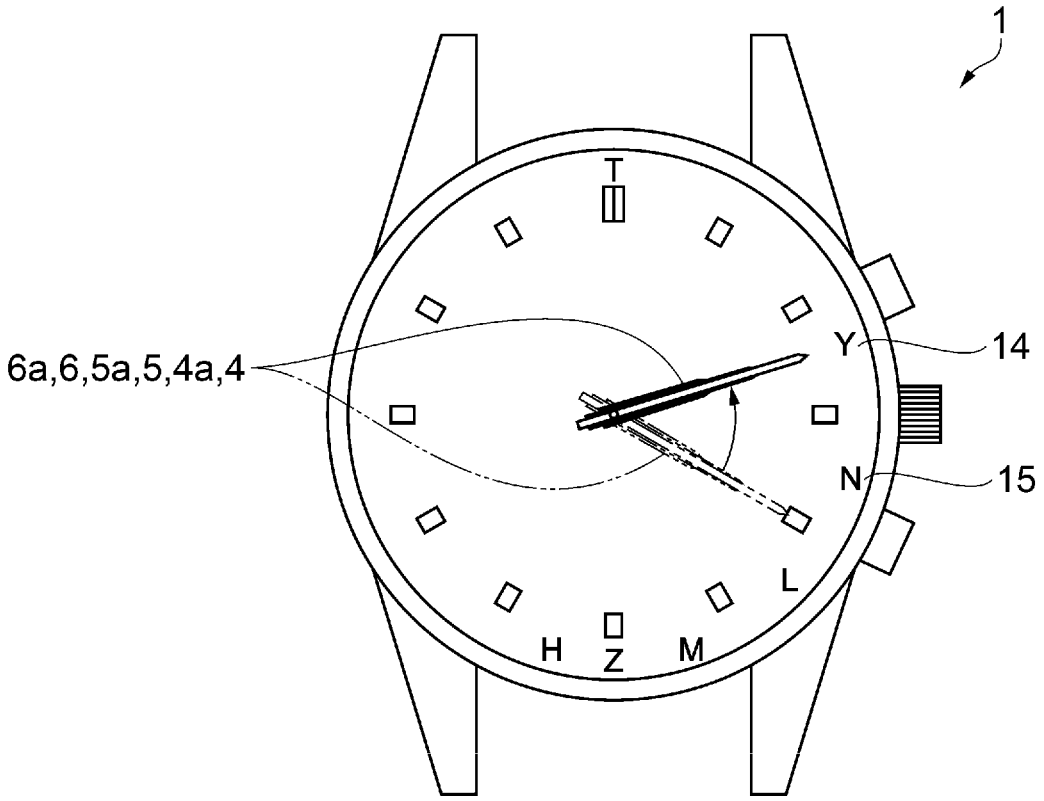
FIG. 17 is a diagram for explaining the hand moving control during the manual reception processing.

FIG. 17 is a diagram corresponding to the reception result display step in step S16. As illustrated in FIG. 17, the display controller 61 simultaneously rotates the hour hand 4, the minute hand 5, and the seconds hand 6. Then, the display controller 61 makes the hour hand 4, the minute hand 5, and the seconds hand 6 display a result of the positioning reception processing. The third position 14 and the fourth position 15 each displaying the result of the positioning reception processing are set on the dial 3. When the positioning reception processing performed in the first reception step in step S15 is successful, the hour hand 4, the minute hand 5, and the seconds hand 6 point the third position 14. When the positioning reception processing is not successful, the hour hand 4, the minute hand 5, and the seconds hand 6 point the fourth position 15. The operator can know whether the positioning reception processing is successful or not by checking the position pointed by the hour hand 4, the minute hand 5, and the seconds hand 6.

Figure 18:
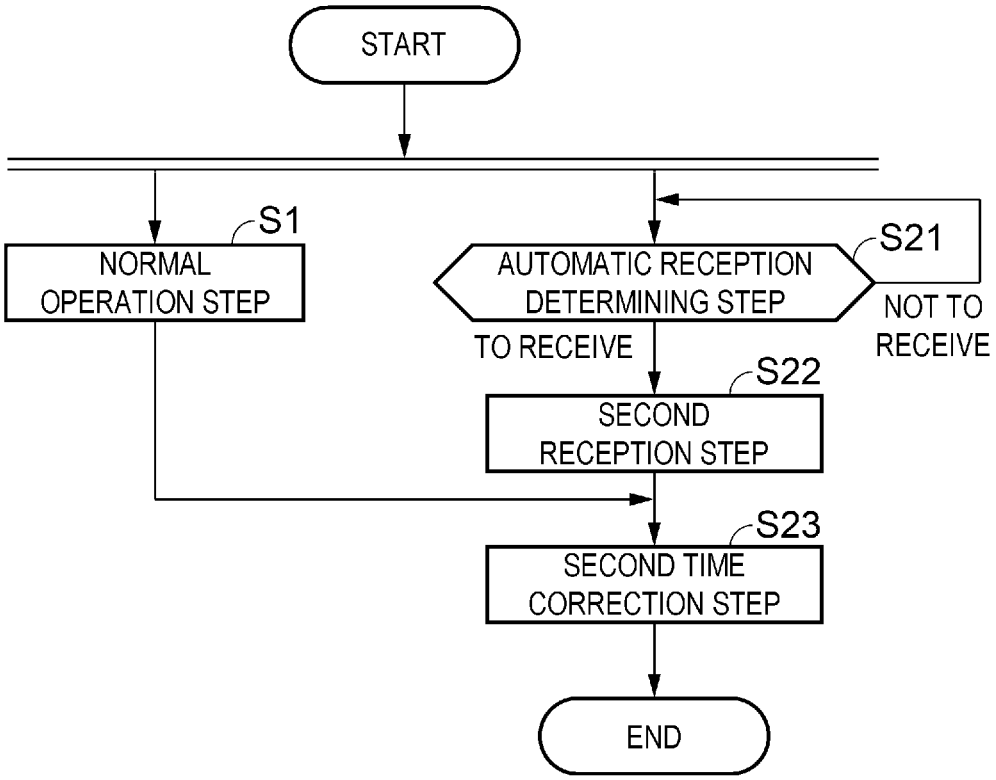
FIG. 18 is a flowchart of a method for controlling automatic reception processing.

Next, a method for controlling the automatic reception processing will be described. FIG. 18 is a flowchart of the method for controlling the automatic reception processing. Step S1 is the normal operation step. Next, the processing transits to step S23.

Step S21 is an automatic reception determining step. In this step, the detector 67 detects a state satisfying an automatic reception condition. The automatic reception condition is that current time reaches reception time, or the light sensor 40 detects intense light. At this time, the reception mode controller 63 determines to receive a satellite signal from the satellite 23 and perform the time keeping reception processing. When the detector 67 does not detect a state satisfying the automatic reception condition, the reception mode controller 63 does not receive a satellite signal from the satellite 23. Determination is made not to perform the time keeping reception processing. When the reception mode controller 63 determines to receive a satellite signal, then the processing transits to step S22. When the reception mode controller 63 determines not to receive a satellite signal, step S21 continues. Step S1 and step S21 are performed in parallel.

Step S22 is a second reception step. In step S22, the time keeping reception controller 64 performs the time keeping reception processing. Step S22 and step S1 are performed in parallel. Next, the processing transits from step S1 and step S22 to step S23.

Step S23 is a second time correction step. This step is a step in which the time information correction controller 62 corrects time. Local time is corrected from time obtained in the time keeping reception processing, and is transmitted to the display controller 61. The display controller 61 drives the drive mechanism 60 to make the hour hand 4, the minute hand 5, and the seconds hand 6 display the time. Then the processing returns to normal hand moving. With the above steps, the hand moving control during the automatic reception processing ends.

When the detector 67 detects that the automatic reception condition is satisfied, the display controller 61 does not perform an operation for overlapping the first conductive portion 4*a* and the third conductive portion 5*a* and the second conductive portion 6*a* with each other in plan view, the planar inverted-F antenna 41 receives a radio wave, and the time keeping reception controller 64 detects time. In the case of the automatic reception, the operator is less likely to see the hour hand 4, the minute hand 5, and the seconds hand 6, thus the hour hand 4, the minute hand 5, and the seconds hand 6 do not rotate to point the second position 13. Since a radio wave can be received from the satellite 23 without overlapping the first conductive portion 4*a* and the third conductive portion 5*a* and the second conductive portion 6*a* with each other, a radio wave is received without performing an operation for overlapping the first conductive portion 4*a* and the second conductive portion 6*a* and the third conductive portion 5*a* with each other. At this time, power required to move the hour hand 4, the minute hand 5, and the seconds hand 6 can be suppressed.

The rotation of the hour hand 4, the minute hand 5, and the seconds hand 6, and the reception of a radio wave by the planar inverted-F antenna 41 are performed in parallel. The time keeping reception controller 64 uses a radio wave received by the planar inverted-F antenna 41 to detect time. At this time, the watch 1 can reduce time taken to detect the time.

Second Exemplary Embodiment

Next, an exemplary embodiment of the watch will be described with reference to FIG. 19 to FIG. 21. The present exemplary embodiment differs from the first exemplary embodiment in that the hour hand 4, the minute hand 5, and the seconds hand 6 are rotated simultaneously.

Note that, the descriptions for the points identical to those of the first exemplary embodiment are omitted.

Figure 19:
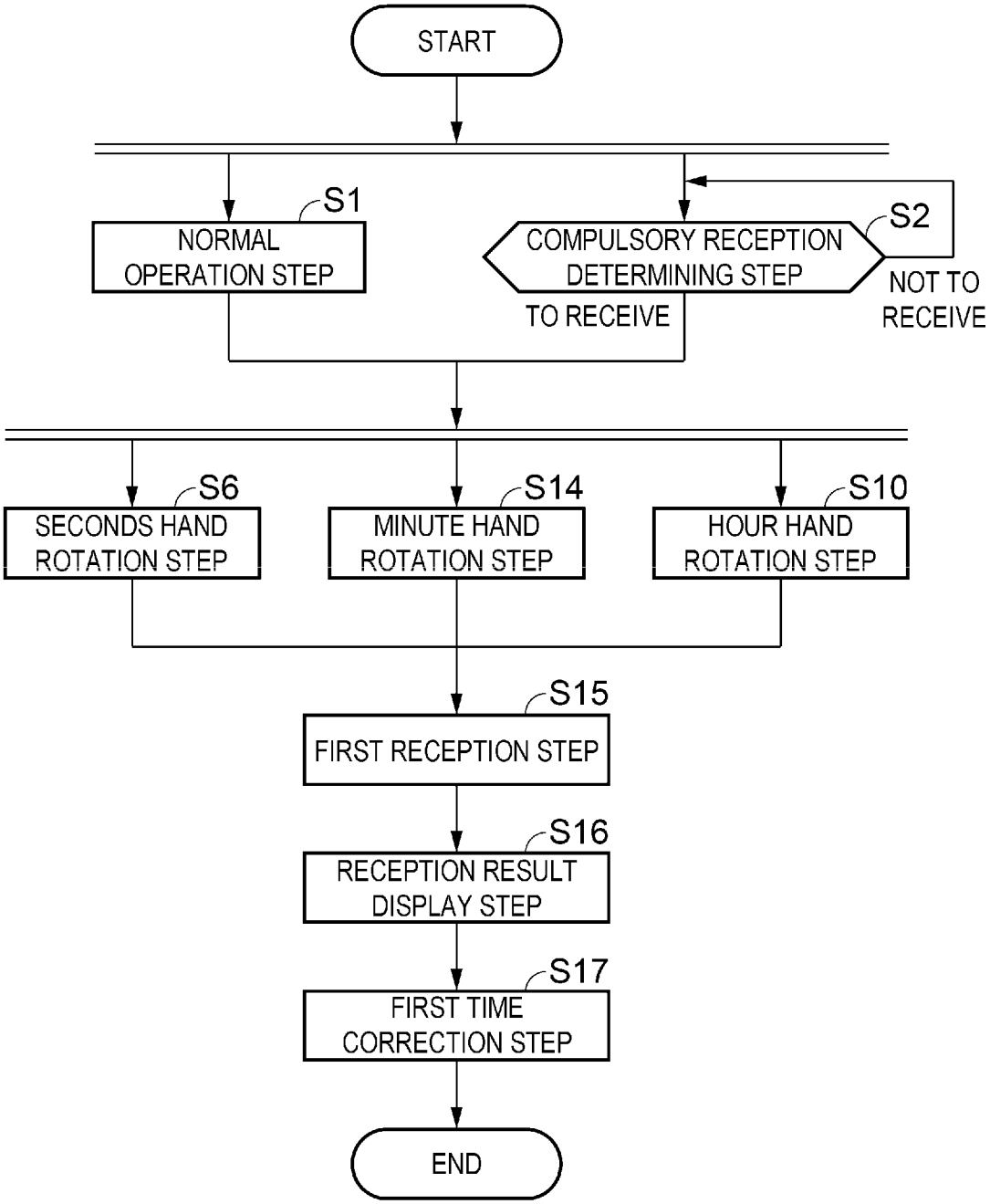
FIG. 19 is a flowchart of a method for controlling manual reception processing according to a second exemplary embodiment.

FIG. 19 is a flowchart of a method for controlling the manual reception processing. In other words, in the present exemplary embodiment, as illustrated in FIG. 19, the normal operation step in step S1 and the manual reception determining step in step S2 are performed in parallel. When the reception mode controller 63 determines to receive a satellite signal, then the processing transits from step S1 and step S2 to step S6, step S10, and step S14.

The seconds hand rotation step in step S6, the hour hand rotation step in step S10, and the minute hand rotation step in step S14 are performed in parallel. The contents of step S6, step S10, and step S14 are identical to those in the first exemplary embodiment. Next, the processing transits to step S15, and step S15 to step S17 are performed sequentially. The contents of step S15 to step S17 are identical to those in the first exemplary embodiment. With the above steps, the controlling of the manual reception processing ends.

Figure 20:
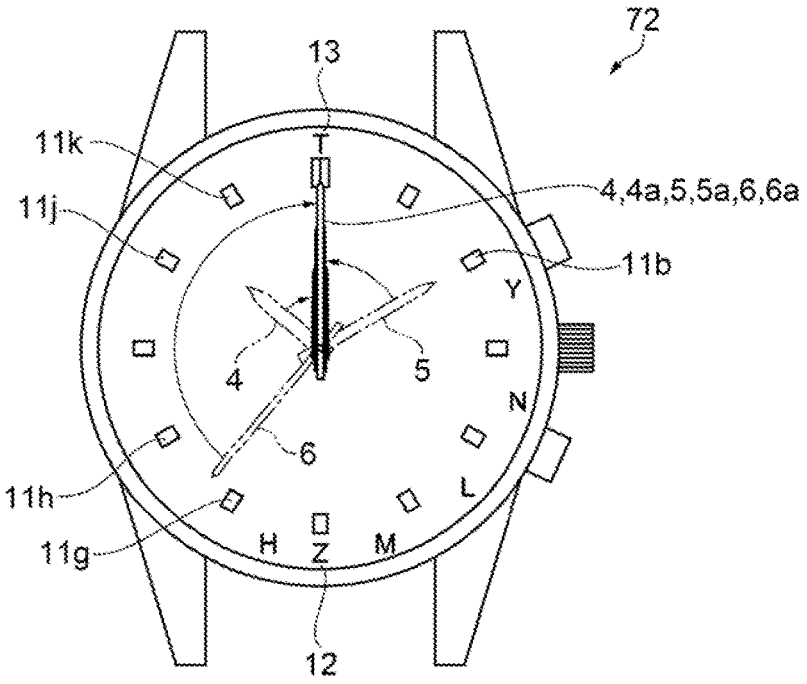
FIG. 20 is a diagram for explaining hand moving control during the manual reception processing.
Figure 21:
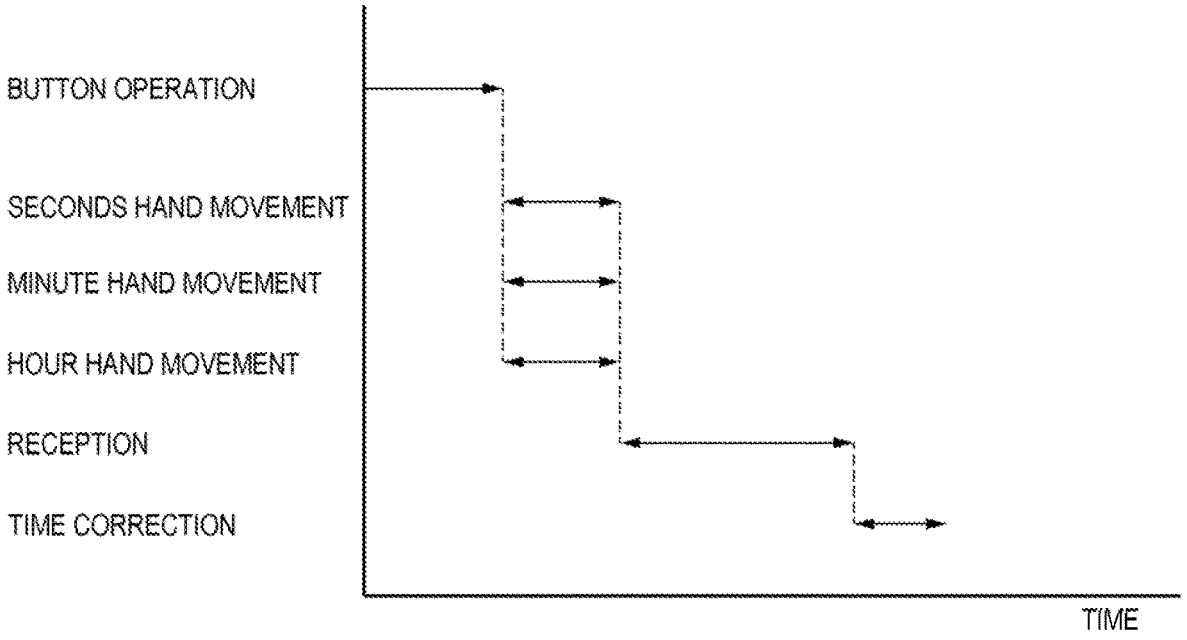
FIG. 21 is a diagram for explaining the hand moving control during the manual reception processing.

FIG. 20 and FIG. 21 are diagrams for explaining hand moving control during reception processing of a satellite signal in the manual reception. FIG. 20 is a diagram corresponding to the seconds hand rotation step in step S6, the hour hand rotation step in step S10, and the minute hand rotation step in step S14, and is a diagram when time keeping reception is performed. As illustrated in FIG. 20, the seconds hand 6 in a watch 72 points between the seventh indicator 11*g* and the eighth indicator 11*h*. The minute hand 5 points the second indicator 11*b*. The hour hand 4 points between the tenth indicator 11*j* and the eleventh indicator 11*k*.

When the planar inverted-F antenna 41 receives a radio wave and performs the time keeping reception, the display controller 61 simultaneously rotates the hour hand 4, the minute hand 5, and the seconds hand 6 toward the second position 13, and overlaps the first conductive portion 4*a* and the third conductive portion 5*a* and the second conductive portion 6*a* with each other in plan view. When positioning reception is performed, the display controller 61 simultaneously rotates the hour hand 4, the minute hand 5, and the seconds hand 6 toward the first position 12, and overlaps the first conductive portion 4*a* and the third conductive portion 5*a* and the second conductive portion 6*a* with each other in plan view. Then, when the hour hand 4, the minute hand 5, and the seconds hand 6 move simultaneously toward a reception indication position, an operator is informed by handling instructions that the planar inverted-F antenna 41 receives a radio wave.

FIG. 21 is a time chart illustrating the procedure from step S2 to S17. As illustrated in FIG. 21, first, a button operation is performed in which the operator presses the second button 21. Next, the display controller 61 rotates the hour hand 4, the minute hand 5, and the seconds hand 6 simultaneously. In the case of the time keeping reception, the hour hand 4, the minute hand 5, and the seconds hand 6 point the second position 13. In the case of the positioning reception, the hour hand 4, the minute hand 5, and the seconds hand 6 point the first position 12. The receiver 57 receives a radio wave with the hour hand 4, the minute hand 5, and the seconds hand 6 overlapping with each other.

Time keeping reception processing or positioning reception processing is performed. When the timekeeping reception processing or the positioning reception processing is successful, the time information correction controller 62 corrects time. Then, the display controller 61 makes the hour hand 4, the minute hand 5, and the seconds hand 6 display current time.

The display controller 61 simultaneously moves the hour hand 4, the minute hand 5, and the seconds hand 6. When the hour hand 4, the minute hand 5, and the seconds hand 6 move simultaneously toward the first position 12 or the second position 13, the operator is informed that the planar inverted-F antenna 41 receives a radio wave. Then, the operator sees the operation of the hour hand 4, the minute hand 5, and the seconds hand 6 to know that the planar inverted-F antenna 41 receives a radio wave.

Thus, the watch 1 can simultaneously move the first conductive portion 4*a* and the third conductive portion 5*a* and the second conductive portion 6*a* and overlap the conductive portions with each other when a radio wave is received, to quickly notify the operator that the planar inverted-F antenna 41 receives a radio wave.

Note that, in the present exemplary embodiment, "simultaneous" includes substantially simultaneous.

Third Exemplary Embodiment

Next, an exemplary embodiment of the watch will be described with reference to FIG. 22 to FIG. 25. The present embodiment differs from the first exemplary embodiment in that the hour hand 4, the minute hand 5, and the seconds hand 6 reach the first position 12 or the second position 13 simultaneously. Note that, the descriptions for the points identical to those of the first exemplary embodiment are omitted.

Figure 22:
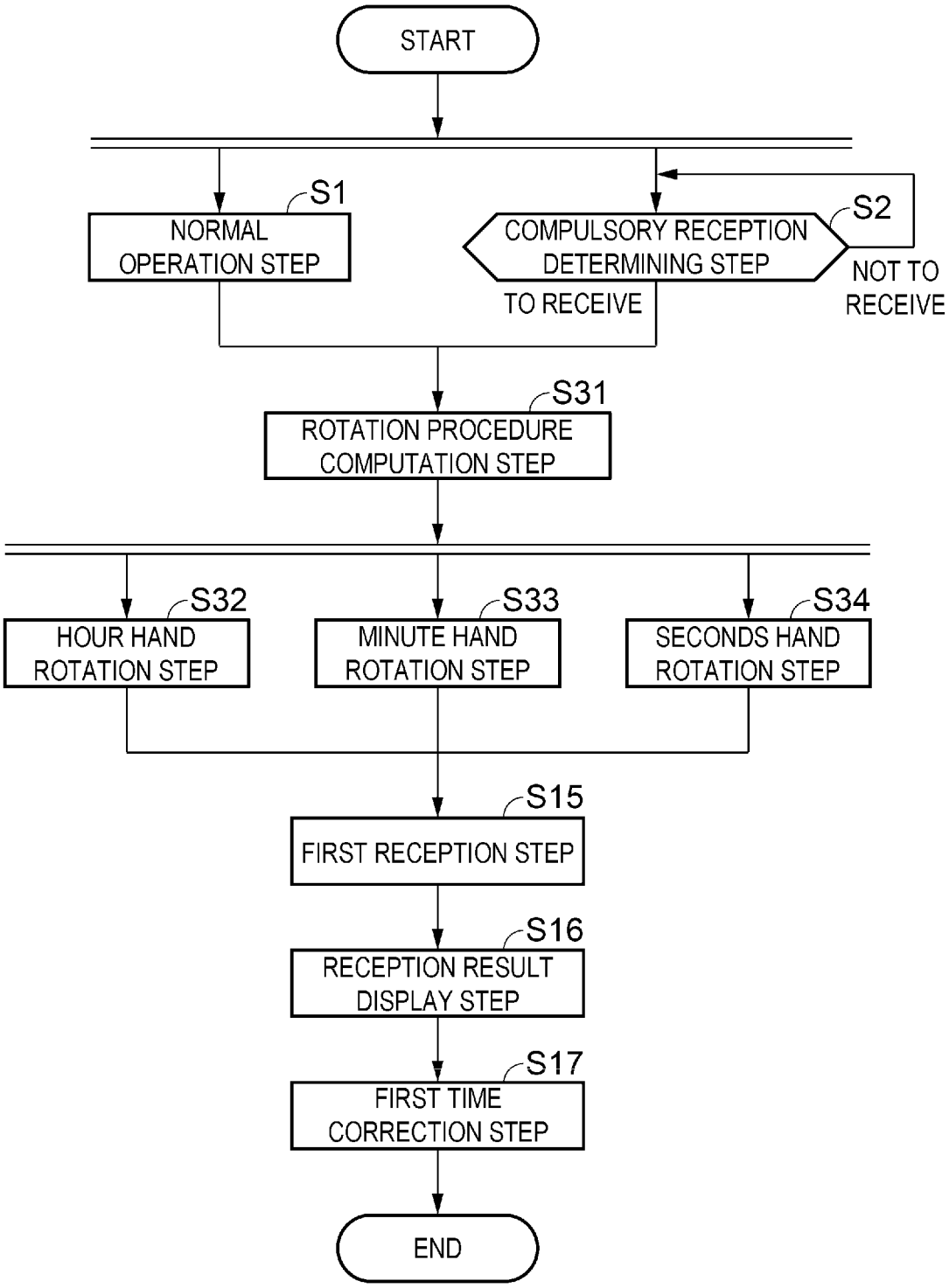
FIG. 22 is a flowchart of a method for controlling manual reception processing according to a third exemplary embodiment.

FIG. 22 is a flowchart of a method for controlling manual reception processing. In other words, in the present exemplary embodiment, as illustrated in FIG. 22, the normal operation step in step S1 and the manual reception determining step in step S2 are performed in parallel. When the reception mode controller 63 determines to receive a satellite signal, then the processing transits from step S1 and step S2 to step S31.

Step S31 is a rotation procedure computation step. This step is a step in which the display controller 61 computes a procedure for rotating the hour hand 4, the minute hand 5, and the seconds hand 6. In a case of time keeping reception, when the hour hand 4, the minute hand 5, and the seconds hand 6 are rotated, time taken to reach the second position 13 is computed for each the hand. Then, in order to make the hour hand 4, the minute hand 5, and the seconds hand 6 simultaneously reach the second position 13, time to start moving is set for each the hand.

In a case of positioning reception, when the hour hand 4, the minute hand 5, and the seconds hand 6 are rotated, time taken to reach the first position 12 is computed for each the hand. Then, in order to make the hour hand 4, the minute hand 5, and the seconds hand 6 simultaneously reach the first position 12, time to start moving is set for each the hand. Next, the processing transits to step S32, step S33 and step S34.

An hour hand rotation step in step S32, a minute hand rotation step in step S33, and a seconds hand rotation step in step S34 are performed in parallel. In step S32, rotation of the hour hand 4 is started at the time set in step S31. In the case of the time keeping reception, the hour hand 4 is rotated to the second position 13. In the case of the positioning reception, the hour hand 4 is rotated to the first position 12.

In step S33, rotation of the minute hand 5 is started at the time set in step S31. In the case of the time keeping reception, the minute hand 5 is rotated to the second position 13. In the case of the positioning reception, the minute hand 5 is rotated to the first position 12. In step S34, rotation of the seconds hand 6 is started at the time set in step S31. In the case of the time keeping reception, the seconds hand 6 is rotated to the second position 13. In the case of the positioning reception, the seconds hand 6 is rotated to the first position 12. As a result, in the case of the time keeping reception, the hour hand 4, the minute hand 5, and the seconds hand 6 simultaneously reach the second position 13. In the case of the positioning reception, the hour hand 4, the minute hand 5, and the seconds hand 6 simultaneously reach the first position 12.

Thereafter, the first reception step in step S15, the reception result display step in step S16, and the first time correction step in step S17 are performed in this order.

Figure 23:
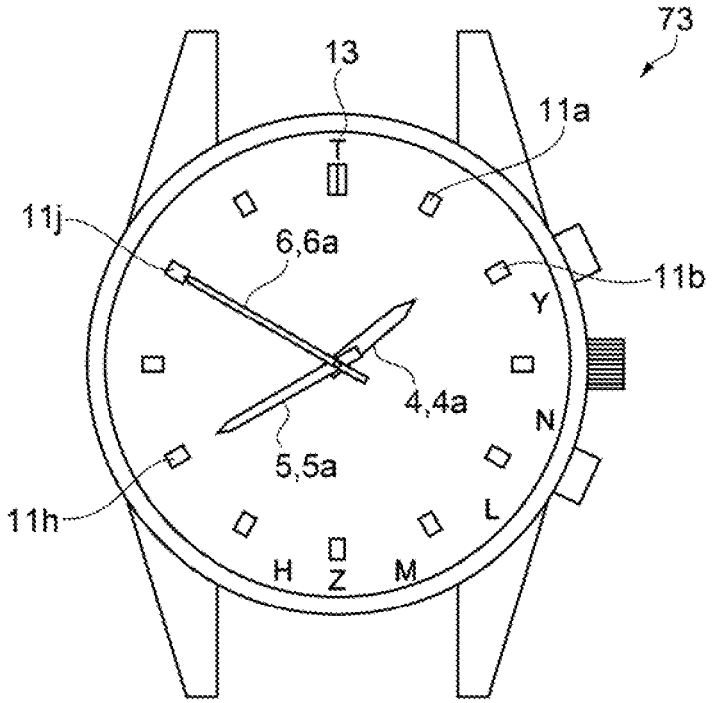
FIG. 23 is a diagram for explaining hand moving control during the manual reception processing.
Figure 24:
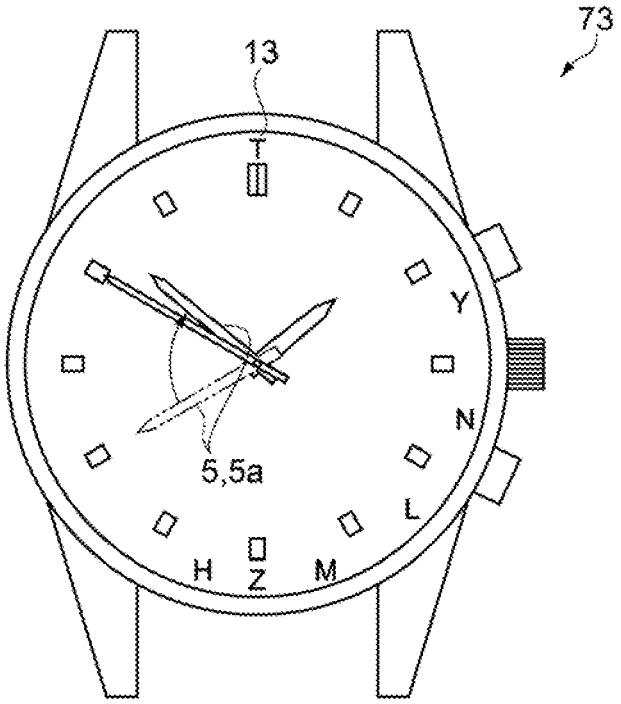
FIG. 24 is a diagram for explaining the hand moving control during the manual reception processing.
Figure 25:
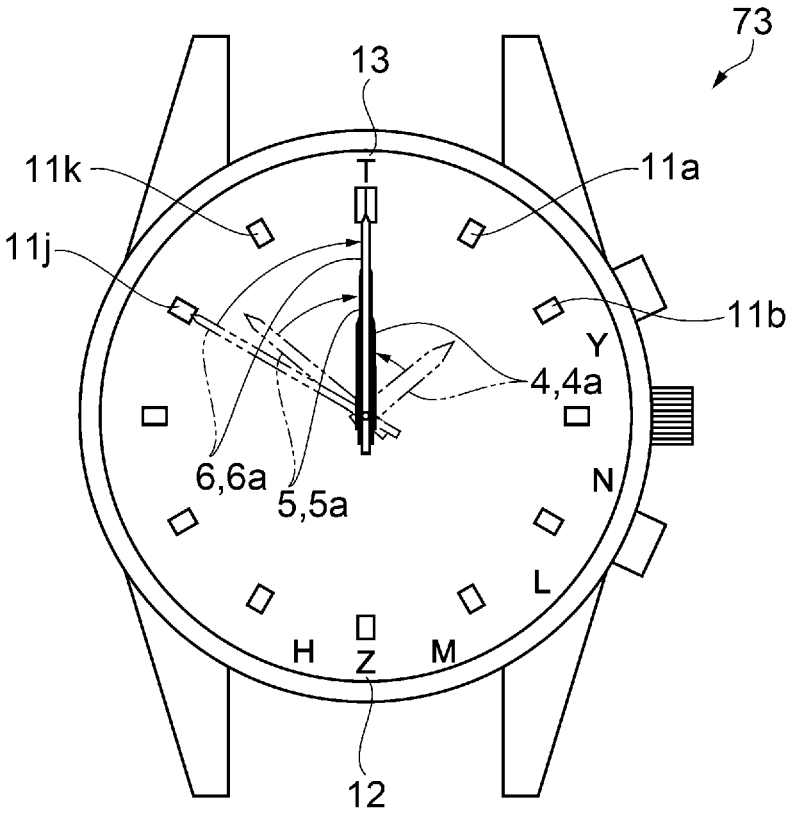
FIG. 25 is a diagram for explaining the hand moving control during the manual reception processing.

FIG. 23 to FIG. 25 are diagrams for explaining hand moving control during reception processing of a satellite signal in the manual reception. Next, with reference to FIG. 23 to FIG. 25, while associating with the steps illustrated in FIG. 22, hand moving control during time keeping reception processing in the manual reception will be described in detail. FIG. 23 is a diagram corresponding to the rotation procedure computation step in step S31. As illustrated in FIG. 23, the hour hand 4 in a watch 73 points between the first indicator 11*a* and the second indicator 11*b*. The minute hand 5 points the eighth indicator 11*h*. The seconds hand 6 points the tenth indicator 11*j*.

The display controller 61 divides an angle formed by the hour hand 4 and the second position 13 by a moving speed of the hour hand 4.

The display controller 61 calculates time taken for the hour hand 4 to move to the second position 13. Similarly, the display controller 61 calculates time taken to move to the second position 13 for each of the minute hand 5 and the seconds hand 6. Then, time at which the hand that takes longer time for moving to the second position 13 starts rotation is set to be earlier. Time at which the hand that takes shorter time for moving to the second position 13 starts rotation is set to be later. In the case of the present exemplary embodiment, since time taken for the minute hand 5 to move to the second position 13 is longer, time at which the minute hand 5 starts to rotate is set to be earlier. A rotational speed of the seconds hand 6 is faster compared to the hour hand 4 and the minute hand 5. Since the time taken for the seconds hand 6 to move to the second position 13 is shorter, time at which the seconds hand 6 starts to rotate is set to be later. Note that, when respective movement speeds of the hour hand 4, the minute hand 5, and the seconds hand 6 are identical to each other, time to start rotation may be set according to a position and an angle for each pointer.

FIG. 24 is a diagram corresponding to the minute hand rotation step in step S33. As illustrated in FIG. 24, the display controller 61 rotates the minute hand 5 in advance of the hour hand 4 and the seconds hand 6.

FIG. 25 is a diagram corresponding to the hour hand rotation step in step S32, the minute hand rotation step in step S33, and the seconds hand rotation step in step S34. As illustrated in FIG. 25, when the minute hand 5 points between the tenth indicator 11*j* and the eleventh indicator 11*k*, the display controller 61 starts rotation of the hour hand 4. Subsequently, the display controller 61 starts rotation of the seconds hand 6. As a result, the hour hand 4, the minute hand 5, and the seconds hand 6 reach the second position 13 simultaneously. An operator is informed in advance by handling instructions that the time keeping reception is performed when the hour hand 4, the minute hand 5, and the seconds hand 6 reach the second position 13 simultaneously. The operator can observe the movement of the hour hand 4, the minute hand 5, and the seconds hand 6 to know that the time keeping reception is performed. Since the hand far from the second position 13 starts to move at first, it is possible to quickly inform the operator that the time keeping reception is performed.

When the positioning reception is performed as well, the display controller 61 rotates the hour hand 4, the minute hand 5, and the seconds hand 6 in a similar procedure. Then, the hour hand 4, the minute hand 5, and the seconds hand 6 are made to reach the first position 12 simultaneously. The operator is informed in advance by the handling instructions that the positioning reception is performed when the hour hand 4, the minute hand 5, and the seconds hand 6 reach the first position 12 simultaneously. The operator can observe the movement of the hour hand 4, the minute hand 5, and the seconds hand 6 to know that the positioning reception is performed. Since the hand far from the first position 12 starts to move at first, it is possible to quickly inform the operator that the positioning reception is performed.

Note that, in the present exemplary embodiment, "simultaneous" includes substantially simultaneous.

Modification 1

In the first exemplary embodiment, metal is used for the hour hand shaft 7, the minute hand shaft 8, and the seconds hand shaft 9. The hour hand shaft 7, the minute hand shaft 8, and the seconds hand shaft 9 may be formed of a ceramic or a resin material. When formed of a ceramic, wear of the hour hand shaft 7, the minute hand shaft 8, and seconds hand shaft 9 can be reduced.

When formed of a resin material, the hour hand shaft 7, the minute hand shaft 8, and the seconds hand shaft 9 can be easily manufactured using an injection molding machine.

Modification 2

In the first exemplary embodiment, the first button 19 accepts a reception instruction for the positioning reception of a satellite signal operated by the operator. The second button 21 accepts a reception instruction for the time keeping reception of a satellite signal operated by the operator. In addition, a reception instruction for the positioning reception and a reception instruction for the time keeping reception may be accepted by an operation of the crown 22. In addition, a method for selecting the positioning reception or the time keeping reception may be set according to the number of times or an order of pressing of the first button 19 or the second button 21.

Modification 3

In the first exemplary embodiment, the hour hand 4, the minute hand 5, and the seconds hand 6 are not overlapped with each other in plan view during the automatic reception, and the time keeping reception is performed. When a radio wave received is weak, the hour hand 4, the minute hand 5, and the seconds hand 6 may be overlapped with each other in plan view. A probability of making the time keeping reception successful can be increased.

Modification 4

In the first exemplary embodiment, in the case of the time keeping reception during the manual reception, after rotating the hour hand 4, the minute hand 5, and the seconds hand 6, the time keeping reception is performed. In the case of the time keeping reception during the manual reception, rotation of the hour hand 4, the minute hand 5, and the seconds hand 6, and reception of a radio wave by the planar inverted-F antenna 41 may be performed in parallel. For example, in the manual reception determining step S2, when the reception mode controller 63 determines to receive a satellite signal, the seconds hand rotation direction determining step S3, the first seconds hand rotation step S4, or the second seconds hand rotation step S5, and the first reception step S15 may be performed simultaneously. When a radio wave is strong, the time keeping reception can be performed even when the hour hand 4, the minute hand 5, and the seconds hand 6 are rotating. At this time, the watch 1 can reduce time taken to detect the time.

Modification 5

In the first exemplary embodiment, the entire of each of the hour hand 4, the minute hand 5, and the seconds hand 6 is constituted by the metallic conductive material. Apart of each of the hour hand 4, the minute hand 5, and the seconds hand 6 may be formed of resin. At this time, a part of the hour hand 4 that is constituted by a conductive material is the first conductive portion 4*a*. A part of the minute hand 5 that is constituted by the conductive material is the third conductive portion 5*a*. A part of the seconds hand 6 that is constituted by the conductive material is the second conductive portion 6*a*.

Modification 6

In each of the exemplary embodiments described above, the planar inverted-F antenna is used as an antenna for receiving a radio wave, but other antennas such as patch antennas may be used. In particular, each of the exemplary embodiments is effective, when a planar antenna is used that overlaps in plan view with a plurality of pointers, regardless of respective positions of the plurality of pointers.

Modification 7

In each of the exemplary embodiments described above, the watch is described that includes the hour hand 4, the minute hand 5, and the seconds hand 6, but for example, a watch may also be used that does not include a seconds hand, or another hand including a conductive part, such as a counting wheel that is fixed coaxially with the hour hand 4 and the minute hand 5 may be included. In these cases as well, by overlapping conductive portions of respective pointers with each other during reception, a decrease in reception sensitivity by an antenna can be reduced.

Contents derived from the exemplary embodiments will be described below.

A watch includes a first pointer having a first conductive portion and configured to rotate about a first shaft as an axis, a second pointer having a second conductive portion and configured to rotate at a rotational speed faster than that of the first pointer about a second shaft, which is coaxial with the first shaft, as an axis, a drive mechanism configured to rotate the first pointer and the second pointer, a controller configured to control rotation of the first pointer and the second pointer, and an antenna disposed, in plan view viewed from a direction parallel to the first shaft, at a position overlapping a rotation range of the first conductive portion and a rotation range of the second conductive portion, and configured to receive a radio wave, wherein when the antenna receives the radio wave, the controller, after rotating the second pointer and then stopping the second pointer at a reception indication position, rotates the first pointer such that the first conductive portion and the second conductive portion overlap each other in the plan view.

According to this configuration, when the antenna receives a radio wave, the controller overlaps the first conductive portion with the second conductive portion. At this time, an area where the first conductive portion and the second conductive portion overlap with the antenna in plan view is minimized. Thus, floating capacitance between the first conductive portion and the second conductive portion, and the antenna is also minimized. Then, the controller moves the second pointer and stops the second pointer at the reception indication position. Since the stop position of the second pointer is the reception indication position, an operator knows that the antenna receives a radio wave. A rotational speed of the second pointer is faster than that of the first pointer. Thus, when the first conductive portion is overlapped with the second conductive portion, compared to when the controller moves the first pointer to the reception indication position in advance, a probability of the second pointer reaching the reception indication position in a short period time is higher when the second pointer is moved to the reception indication position in advance. Thus, when the first conductive portion is overlapped with the second conductive portion when a radio wave is received, the watch can quickly notify the operator that the antenna receives a radio wave.

A watch includes a first pointer having a first conductive portion and configured to rotate about a first shaft as an axis, a second pointer having a second conductive portion and configured to rotate about a second shaft, which is coaxial with the first shaft, as an axis, a drive mechanism configured to rotate the first pointer and the second pointer, a controller configured to control rotation of the first pointer and the second pointer, and an antenna disposed, in plan view viewed from a direction parallel to the first shaft, at a position overlapping a rotation range of the first conductive portion and a rotation range of the second conductive portion, and configured to receive a radio wave, wherein when the antenna receives the radio wave, the controller rotates the first pointer and the second pointer simultaneously toward a reception indication position such that the first conductive portion and the second conductive portion overlap each other in the plan view.

According to this configuration, the controller moves the first pointer and the second pointer simultaneously. When the first pointer and the second pointer move simultaneously toward the reception indication position, an operator is informed that the antenna receives a radio wave. Then, the operator views operation of the hand and knows that the antenna receives a radio wave. Thus, when the first conductive portion is overlapped with the second conductive portion when a radio wave is received, the watch can quickly notify the operator that the antenna receives a radio wave.

In the watch described above, the reception indication position may include a first position and a second position, and the controller, when receiving the radio wave and detecting a position, may cause the first conductive portion and the second conductive portion to overlap each other at the first position, and, when receiving the radio wave and detecting time, may cause the first conductive portion and the second conductive portion to overlap each other at the second position.

According to this configuration, when the first conductive portion overlaps with the second conductive portion at the first position, the operator can know that the controller detects a position. When the first conductive portion overlaps with the second conductive portion at the second position, the operator can know that the controller detects time.

In the watch described above, the radio wave may be transmitted from a position information satellite, the watch further including a receiver configured to process the radio wave received by the antenna and capture the position information satellite, and the controller may rotate the first pointer and the second pointer in a state, in which the first conductive portion and the second conductive portion overlap each other in the plan view, and indicate the number of the position information satellites captured by the receiver.

According to this configuration, the first pointer and the second pointer display the number of the position information satellites captured by the receiver. In a state in which the antenna easily receives a radio wave, the first pointer and the second pointer can inform the operator of the number of the position information satellites captured by the receiver.

In the watch described above, the controller may rotate the first pointer and the second pointer in a state in which the first conductive portion and the second conductive portion overlap each other in the plan view, and indicate strength of the radio wave received by the antenna.

According to this configuration, the first pointer and the second pointer display strength of a radio wave received by the antenna. In the state in which the antenna easily receives a radio wave, the first pointer and the second pointer can inform the operator of strength of a radio wave received by the antenna.

The watch described above may include an input device configured to accept an instruction for comoulsory reception, the controller may include a detector for detecting that a predetermined automatic reception condition is met, the controller may cause the first conductive portion and the second conductive portion to overlap each other in the plan view when the input device accepts an instruction for the manual reception, and the antenna receives the radio wave, and when the detector detects that the automatic reception condition is met, the controller does not perform an operation of causing the first conductive portion and the second conductive portion to overlap each other in the plan view, and the antenna may receive the radio wave and the controller may detect time.

According to this configuration, the operator operates the input device to instruct for the manual reception. At this time, the controller moves the first pointer and the second pointer to overlap the first conductive portion with the second conductive portion. In this way, the operator knows that the antenna receives a radio wave. The detector detects that the automatic reception condition is satisfied. The automatic reception condition is detection of predetermined time, detection of sunlight, or the like.

At this time, the antenna starts receiving of a radio wave. At this time, since the operator is unlikely to see the first pointer and the second pointer, an operation of overlapping the first conductive portion with the second conductive portion is not performed, and a radio wave is received. Accordingly, power required for moving the first pointer and the second pointer can be suppressed.

In the watch described above, the rotation of the second pointer and the reception of the radio wave by the antenna may be performed in parallel, and the controller may use the radio wave, which is received, to detect time.

According to this configuration, the controller detects time. At this time, the movement of the second pointer and the reception of a radio wave by the antenna are performed in parallel. Thus, since an end of the movement of the second pointer is not waited for and a radio wave is received, time required for the detection of time can be shortened.

In the watch described above, after the first conductive portion and the second conductive portion are caused to overlap each other in the plan view, the radio wave may be received by the antenna.

According to this configuration, when a radio wave is received by the antenna, the first conductive portion is overlapped with the second conductive portion in plan view viewed from a direction parallel to the first shaft. Thus, the antenna can receive a radio wave with good sensitivity.

The watch described above may include an outer packaging case including a case body, a case back, and a cover member, and a dial disposed between the cover member and the case back in the outer packaging case, wherein the antenna may include a first conductor element that is planar and disposed between the dial and the case back in a side view viewed from a direction perpendicular to the first shaft, a second conductor element that is disposed between the dial and the case back so as to be separated from the first conductor element and overlaps the first conductor element in the plan view, and a short-circuit portion that short-circuits the first conductor element and the second conductor element, and the first shaft to which the first pointer is attached and the second shaft to which the second pointer is attached may be constituted of a conductive material.

According to this configuration, the first shaft and the second shaft are conductive. At this time, by using metal for a material of the first shaft and the second shaft, the first shaft and the second shaft support the first pointer and the second pointer respectively with good durability. At this time, currents flow through the first shaft, the second shaft, the first conductive portion, and the second conductive portion. There is a possibility that influence of parasitic capacitance occurring between the first conductor element and the first conductive portion, and the second conductive portion increases, shifting of a resonant frequency occurs, and reception sensitivity decreases.

Since an area of the first conductive portion and the second conductive portion that faces the first conductor element is minimized, the parasitic capacitance occurring between the first conductive portion and the second conductive portion and the first conductor element is also minimized. The shifting of the resonant frequency in the antenna due to the influence of the parasitic capacitance is reduced, and the decrease in reception sensitivity can also be suppressed to be minimum.

A method for controlling a watch is a method for controlling a watch that includes a first pointer having a first conductive portion and rotating about a first shaft as an axis, a second pointer having a second conductive portion and rotating at a rotational speed faster than that of the first pointer about a second shaft, which is coaxial with the first shaft, as an axis, a drive mechanism configured to rotate the first pointer and the second pointer, a controller configured to control rotation of the first pointer and the second pointer, and an antenna disposed, in plan view viewed from a direction parallel to the first shaft, at a position overlapping a rotation range of the first conductive portion and a rotation range of the second conductive portion, and receiving a radio wave, the method including, when the antenna receives the radio wave, causing the controller to induce rotation of the second pointer to stop the second pointer at a reception indication position; and after the second pointer stops at the reception indication position, rotation of the first pointer such that the first conductive portion and the second conductive portion overlap each other in the plan view.

According to this method for controlling, when the antenna receives a radio wave, the controller rotates the second pointer. After the second pointer is stopped at the reception indication position, the controller rotates the first pointer. The first conductive portion is overlapped with the second conductive portion in plan view viewed from the direction parallel to the first shaft. Accordingly, floating capacitance between the first conductive portion and the second conductive portion, and the antenna is reduced.

Since the stop position of the second pointer is the reception indication position, an operator knows that the antenna receives a radio wave. A rotational speed of the second pointer is faster than that of the first pointer. Thus, when the first conductive portion is overlapped with the second conductive portion, compared to when the controller moves the first pointer to the reception indication position in advance, a probability of the second pointer reaching the reception indication position in a short period time is higher when the second pointer is moved to the reception indication position in advance. Therefore, when the first conductive portion is overlapped with the second conductive portion during reception, the method for controlling the watch can quickly notify the operator that the antenna receives a radio wave.

What is claimed is:

1. A watch, comprising:

a dial;

a first pointer having a first conductive portion and configured to rotate about a first shaft as an axis;

a second pointer having a second conductive portion and configured to rotate at a rotational speed faster than that of the first pointer about a second shaft, which is coaxial with the first shaft, as an axis;

a drive mechanism configured to rotate the first pointer and the second pointer;

a controller configured to control rotation of the first pointer and the second pointer; and an antenna disposed, in plan view viewed from a direction parallel to the first shaft, at a position overlapping a rotation range of the first conductive portion and a rotation range of the second conductive portion, and configured to receive a radio wave, wherein the antenna includes a pair of planar conductor elements that overlap an entirety of the dial in a plan view of the watch; and in response to the antenna receiving the radio wave, the controller is configured to rotate the second pointer and stop the second pointer at a reception indication position, and after rotating and stopping the second pointer, the controller is configured to rotate the first pointer such that the first conductive portion and the second conductive portion overlap each other in the plan view.

2. The watch according to claim 1, wherein the reception indication position includes a first position and a second position, and the controller, when receiving the radio wave and detecting a position, causes the first conductive portion and the second conductive portion to overlap each other at the first position, and, when receiving the radio wave and detecting time, causes the first conductive portion and the second conductive portion to overlap each other at the second position.

3. The watch according to claim 1, wherein the radio wave is transmitted from a position information satellite, the watch further comprising a receiver configured to process the radio wave received by the antenna and capture the position information satellite, and wherein the controller rotates the first pointer and the second pointer in a state, in which the first conductive portion and the second conductive portion overlap each other in the plan view, and indicates the number of the position information satellites captured by the receiver.

4. The watch according to claim 1, wherein the controller rotates the first pointer and the second pointer in a state, in which the first conductive portion and the second conductive portion overlap each other in the plan view, and indicates strength of the radio wave received by the antenna.

5. The watch according to claim 1, comprising an input device configured to accept an instruction for manual reception, wherein the controller includes a detector for detecting that a predetermined automatic reception condition is met, the controller causes the first conductive portion and the second conductive portion to overlap each other in the plan view when the input device accepts an instruction for the manual reception, and the antenna receives the radio wave, and when the detector detects that the automatic reception condition is met, the controller does not perform an operation of causing the first conductive portion and the second conductive portion to overlap each other in the plan view, and the antenna receives the radio wave and the controller detects time.

6. The watch according to claim 1, wherein the rotation of the second pointer and the reception of the radio wave by the antenna are performed in parallel, and the controller uses the radio wave, which is received, to detect time.

7. The watch according to claim 1, wherein after the first conductive portion and the second conductive portion are caused to overlap each other in the plan view, the radio wave is received by the antenna.

8. The watch according to claim 1, comprising:

an outer packaging case including a case body, a case back, and a cover member; and a dial disposed between the cover member and the case back in an inside of the outer packaging case, wherein the antenna includes a first conductor element that is planar and disposed between the dial and the case back in a side view viewed from a direction perpendicular to the first shaft, a second conductor element that is disposed between the dial and the case back so as to be separated from the first conductor element and overlaps the first conductor element in the plan view, and a short-circuit portion that short-circuits the first conductor element and the second conductor element, and the first shaft to which the first pointer is attached and the second shaft to which the second pointer is attached are constituted of a conductive material.

9. A method for controlling a watch including a dial, a first pointer having a first conductive portion and rotating about a first shaft as an axis, a second pointer having a second conductive portion and rotating at a rotational speed faster than that of the first pointer about a second shaft, which is coaxial with the first shaft, as an axis, a drive mechanism configured to rotate the first pointer and the second pointer, a controller configured to control rotation of the first pointer and the second pointer, and an antenna disposed, in plan view viewed from a direction parallel to the first shaft, at a position overlapping a rotation range of the first conductive portion and a rotation range of the second conductive portion, and receiving a radio wave, the method comprising, in response to the antenna receiving the radio wave:

causing the controller to induce rotation of the second pointer and then stopping the second pointer at a reception indication position; and after the second pointer stops at the reception indication position, causing the controller to induce rotation of the first pointer such that the first conductive portion and the second conductive portion overlap each other in the plan view wherein the antenna includes a pair of conductor element that overlap an entirety of the dial in a plan view of the watch.

* * * * *